US010252135B1

(12) United States Patent
Roberts

(10) Patent No.: US 10,252,135 B1
(45) Date of Patent: Apr. 9, 2019

(54) EXERCISE ASSEMBLY

(71) Applicant: Larry Roberts, Ft. Lauderdale, FL (US)

(72) Inventor: Larry Roberts, Ft. Lauderdale, FL (US)

( * ) Notice: Subject to any disclaimer, the term of this patent is extended or adjusted under 35 U.S.C. 154(b) by 0 days.

(21) Appl. No.: 15/420,439

(22) Filed: Jan. 31, 2017

Related U.S. Application Data

(63) Continuation-in-part of application No. 15/405,926, filed on Jan. 13, 2017, now abandoned, which is a continuation-in-part of application No. 14/924,340, filed on Oct. 27, 2015, now Pat. No. 9,839,827.

(60) Provisional application No. 62/236,503, filed on Oct. 2, 2015, provisional application No. 62/177,730, filed on Mar. 23, 2015, provisional application No. 62/122,685, filed on Oct. 27, 2014.

(51) Int. Cl.
*A63B 69/00* (2006.01)
*A63B 69/20* (2006.01)
*A63B 24/00* (2006.01)

(52) U.S. Cl.
CPC ..... *A63B 69/208* (2013.01); *A63B 24/0087* (2013.01); *A63B 69/004* (2013.01)

(58) Field of Classification Search
None
See application file for complete search history.

(56) References Cited

U.S. PATENT DOCUMENTS

| | | | | |
|---|---|---|---|---|
| 26,685 A | | 2/1897 | Smith | |
| 2,140,487 A | | 12/1938 | Waechter | |
| 2,435,864 A | | 2/1948 | Edwards | |
| 2,702,191 A | * | 2/1955 | Lemelson | F41J 7/04 24/303 |
| 2,993,587 A | | 7/1961 | Stone et al. | |
| 3,027,062 A | | 4/1962 | Huss | |
| D198,513 S | | 6/1964 | Caprioli | |
| D214,487 S | | 6/1969 | Reichl | |
| 3,521,743 A | | 7/1970 | Sposito, Jr. | |
| 3,853,220 A | | 12/1974 | Luray | |
| 3,955,315 A | * | 5/1976 | Goodman | A63H 33/26 446/133 |
| 4,221,385 A | * | 9/1980 | Nidy | A63B 67/14 273/126 R |
| 4,470,538 A | | 9/1984 | Heathcock et al. | |
| 4,564,192 A | | 1/1986 | Lebowitz | |
| 4,606,460 A | | 8/1986 | Luray | |
| 4,749,184 A | | 6/1988 | Tobin | |

(Continued)

FOREIGN PATENT DOCUMENTS

| | | |
|---|---|---|
| EP | 0403514 | 1/1994 |
| WO | 2015152950 | 10/2015 |

*Primary Examiner* — Stephen R Crow

(74) *Attorney, Agent, or Firm* — Malloy & Malloy, PL

(57) ABSTRACT

An improved exercise assembly structured to be struck by a user includes a base supporting a shaft on a supporting surface. A support shaft extends outwardly from the supporting surface. At least one rotating targets is connected to the support shaft and extends outwardly. A resistance assembly is adjustably mounted on the shaft into and out of a position relative to a path of travel of at least one rotating target. The position includes the resistance assembly in engagement with at least one rotating target. The rotating target includes an elongated arm including a predetermined weighted construction and a safety portion thereon.

18 Claims, 23 Drawing Sheets

(56) References Cited

U.S. PATENT DOCUMENTS

| | | | |
|---|---|---|---|
| 4,817,941 | A | 4/1989 | McCorry |
| 4,852,743 | A | 8/1989 | Ridgeway |
| 4,865,200 | A | 9/1989 | Sullivan et al. |
| 5,153,402 | A | 10/1992 | Quick et al. |
| 5,218,510 | A | 6/1993 | Bradford |
| 5,251,760 | A | 10/1993 | Smith |
| 5,277,679 | A | 1/1994 | Wells |
| 5,323,896 | A | 6/1994 | Jones |
| 5,342,267 | A | 8/1994 | Adams |
| 5,388,701 | A | 2/1995 | Ridgeway |
| 5,405,000 | A | 4/1995 | Hagedon et al. |
| 5,538,251 | A | 7/1996 | Harper |
| 5,678,695 | A | 10/1997 | Ridgeway et al. |
| 5,722,541 | A | 3/1998 | Lofgren et al. |
| 5,722,920 | A | 3/1998 | Bauer |
| 5,741,535 | A | 4/1998 | Cope et al. |
| 5,762,200 | A | 6/1998 | Goudreau |
| 5,894,932 | A | 4/1999 | Harding et al. |
| 5,899,835 | A | 5/1999 | Puranda |
| 5,901,852 | A | 5/1999 | Jones |
| 5,967,327 | A | 10/1999 | Jones |
| 5,975,307 | A | 11/1999 | Harding et al. |
| 6,006,917 | A | 12/1999 | Loeffler |
| 6,033,348 | A | 3/2000 | Warshauer |
| 6,073,761 | A | 6/2000 | Jones |
| 6,158,589 | A | 12/2000 | Smith et al. |
| 6,223,901 | B1 | 5/2001 | Lofgren et al. |
| 6,289,655 | B1 | 9/2001 | Ridgeway et al. |
| 6,302,274 | B1 | 10/2001 | Ridgeway |
| 6,311,843 | B1 | 11/2001 | Smith et al. |
| 6,675,973 | B1 | 1/2004 | McDonald et al. |
| 6,685,025 | B1 | 2/2004 | Kari |
| 7,085,534 | B2 | 8/2006 | Bentley |
| 7,086,534 | B2 | 8/2006 | Roesel et al. |
| 7,086,997 | B1 | 8/2006 | Fields |
| 7,290,062 | B2 | 10/2007 | Henrion |
| 7,290,662 | B2 | 11/2007 | Lofgren et al. |
| 7,743,924 | B2 | 6/2010 | McDonald et al. |
| 7,882,956 | B2 | 2/2011 | McDonald et al. |
| D667,305 | S | 9/2012 | Kuhn et al. |
| 8,617,034 | B2 | 12/2013 | Eem |
| 8,727,123 | B1 | 5/2014 | Roberts |
| D706,136 | S | 6/2014 | Roberts |
| 9,126,743 | B2 | 9/2015 | Roberts |
| 9,150,343 | B2 | 10/2015 | Roberts |
| 9,839,827 | B1 * | 12/2017 | Roberts ..... A63B 69/208 |
| 2001/0047950 | A1 | 12/2001 | Beneroff et al. |
| 2007/0167297 | A1 | 7/2007 | Stevenson |
| 2008/0029419 | A1 | 2/2008 | Applebaum |
| 2009/0272667 | A1 | 11/2009 | McDonald et al. |
| 2011/0240515 | A1 | 10/2011 | Ridgeway |
| 2014/0128227 | A1 | 5/2014 | Ladas |
| 2014/0246352 | A1 | 9/2014 | Roberts |
| 2014/0302969 | A1 | 10/2014 | Chen |
| 2014/0329646 | A1 | 11/2014 | Johnson |
| 2014/0339129 | A1 | 11/2014 | Roberts |
| 2016/0023078 | A1 | 1/2016 | Haselrig |
| 2016/0107078 | A1 * | 4/2016 | Lattin ..... A63F 9/0208 273/348.3 |

* cited by examiner

10

10

10

500

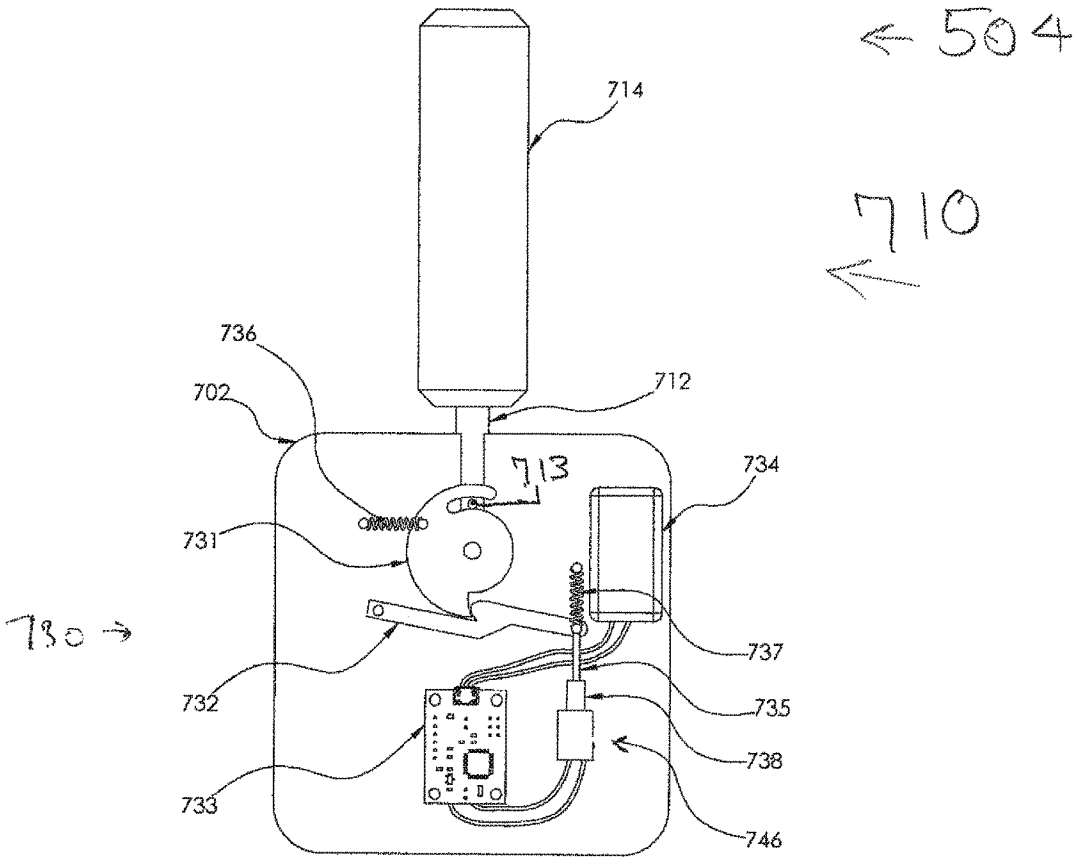
Figure 17-B

EXERCISE ASSEMBLY

CLAIM OF PRIORITY

The present application is a continuation-in-part application of previously filed Ser. No. 14/924,340 filed on Oct. 27, 2015, matured into U.S. Pat. No. 9,839,827 on Dec. 12, 2017, which claims priority to a provisional patent application having U.S. Ser. No. 62/236,503 and a filing date of Oct. 2, 2015, which claims priority to provisional patent application having U.S. Ser. No. 62/177,730 and a filing date of Mar. 23, 2015, which also claims priority to provisional patent application having U.S. Ser. No. 62/122,685 and a filing date of Oct. 27, 2014.

The contents of each of the above are incorporated herein in their entirety by reference.

BACKGROUND OF THE INVENTION

Field of the Invention

The present invention is directed to an exercise assembly which also may be used for training purposes when practicing certain sports activity including, but not limited to, boxing, the martial arts, etc. As such, the exercise assembly includes a plurality of targets, adjustably mounted and disposed on a supporting shaft, wherein each target is structured to be individually and repeatedly struck by the hands, feet, and/or limbs of a user when performing the exercising and/or training routine.

Description of the Related Art

Numerous individuals seek out training devices wanting to exercise or train using self defense techniques. As a result, such individuals frequently require some type of device in order to facilitate their goals. Known devices which are readily available on the commercial market include stationary training products including the heavy punching bag. However, there is always a risk of injury since the bag is by nature heavy and dense, and can damage wrists and ankles if the user does not properly protect his/her body. Other known devices such as reactive training products including various speed bag assemblies allow an individual to practice not only punches and/or kicks, but also speed and accuracy.

Training devices have independently developed to a point where their use is more multi-purpose, where a target can rotate on contact back to the individual, which simulates the unpredictable nature of a real-life sparring partner. However, there appears to be an absence of a combined structure having multi-purpose uses such that a single exercise training device may be utilized as both a stationary training product and a simulated interactive sparring partner where a target can rotate around a shaft on contact from the user. Accordingly, despite the developments and advancements in training devices of the type set forth above, there is still a need for an improved training apparatus which provides targets that simulate an interactive sparring partner with a high enough threshold for absorbing impact, while remaining safe to the user.

SUMMARY OF THE INVENTION

The present invention is directed to an exercise assembly including structural and operative features which facilitates its versatility, thereby allowing it to be used for both exercise and training. More specifically, the exercising and/or training assembly of the present invention is structured with the intent of being repeatedly "struck" by a participating user, as the user simulates activities relating to boxing techniques, the performance of various types of martial arts and/or similar activities.

Accordingly, at least one preferred embodiment of the exercise assembly includes an elongated support shaft or support stanchion which may be mounted on or otherwise connected to different supporting surfaces. As primarily but not exclusively used, the support shaft may be disposed in a vertically upright orientation resting on a supporting surface such as a floor, ground surface or the like. Further, a base may be removably connected to a lower or proximal end of the support shaft while being fixedly or removably connected to the supporting surface. Other anticipated operative orientations of the exercise assembly include the support shaft being mounted in what may be referred to as a substantially "inverted orientation" such as by depending from a ceiling or other raised surface area. Similarly, the support shaft and an appropriately structured base may be secured to a vertical wall so as to extend transversely outward therefrom.

The versatility of the exercise and/or training assembly of the present invention is enhanced by the utilization of a plurality of different types of target structures. Each of the targets may be adjustably mounted along the length of the shaft so as to be positioned at various heights and at various spacing relative to one another. As such, the specific disposition of each of the plurality of targets may be at least partially dependent on the stature of a user. Similarly, the space between and/or relative positioning of the various targets on the shaft may also be dependent on the type of training and/or exercise activity intended to be performed. By way of example, if a user is intending to practice boxing, the plurality of targets are relatively disposed on the shaft so as to facilitate the user throwing different types of punches with the arms and hands. However, if the user is intending to practice different types of martial arts and/or a combination of boxing and martial arts, the plurality of targets may be arranged along the height or length of the shaft at different locations to facilitate the performance of such activity.

Therefore, the exercise assembly of the present invention includes at least one but a possible plurality of fixed, moving, rotating targets adjustably mounted, relative to one another, along the length of the shaft at appropriate positions. In at least one preferred embodiment, the exercise assembly may include at least one but possibly a plurality of rotating targets. Each of the one or more rotating targets includes an elongated arm having both a weighted construction and a safety portion. As explained in greater detail hereinafter, the weighted construction provides the proper overall weight to the elongated arm so as to facilitate its rotation about the shaft in an intended manner, after being struck by the user. Such a weighted construction may include an elongated rigid material member, such as an elongated dowel, disposed within the interior of the arm and extending along a length thereof, substantially intermediate the proximal and distal ends of the arm.

In contrast, the safety portion of the arm of the rotating target may be located along a length contiguous to the distal end of the arm. Further, in order to eliminate or at least restrict the possibility of damage or harm to the user, the safety portion is preferably made of a cushioning material. Such cushioning material may be in the form of a flexible material foam or the like. The safety features associated with the flexible cushioning material are such as to offer at least an appropriate minimal resistance to a punch or blow from the user. Such resistance should be sufficient to facilitate the rotation of the rotating target, once struck, but should be such as to not cause damage to the user's hand, arm, etc. In order to further facilitate the safety features of the one or more rotating targets, the corresponding elongated arm may include an outer sleeve of similarly flexible cushioning and/or foam material. This is due, at least in part to the fact that a continuous rotation of the arm may possibly result in its striking or otherwise engaging the user after completion of a substantially 360° path of rotation about the central axis of the shaft.

As explained in greater detail hereinafter, structural and operative features associated with at least one embodiment of the one or more rotating targets and corresponding arms include the intended rotation thereof through a plurality of continuous rotational paths, in order to provide a greater challenge to the user when performing certain exercises and/or training programs. Accordingly, additional features which facilitate the rotation of the one or more arms defining the one or more rotating targets include the provision of a rotational fitting. Each of the rotational fittings include a one piece and/or integrally formed primary portion and outwardly extending connecting segment. As such, the primary portion and connecting segment may collectively define a substantially T-shape configuration. Moreover, the primary portion has a hollow interior which allows its disposition in surrounding, concentric relation to an exterior of the shaft. However, the relative dimensions between the interior of the primary portion of the rotational fitting and the exterior dimensions of the shaft should be such as to allow the aforementioned intended rotation.

As will also be explained in greater detail hereinafter, the continuous and/or intended rotation of the one or more rotating targets is facilitated by the rotational fitting including two bearing assemblies each disposed at an opposite open end of the primary portion. Further, each bearing assembly is secured by a correspondingly disposed one of two locking collars. Additional features of the preferred bearing assembly include two spaced apart bearing washers disposed in sandwiching relation with an inner bearing structure, such as a thrust bearing.

As set forth above, one intended operation of the rotating target is for the overall structuring, including the weighted construction and the rotational fitting to facilitate a continuous rotation of the elongated arm through a predetermined plurality of preferably three to four complete rotations once being struck by the user. This will further facilitate the performance by a user of a relatively quick or rapid response movement when practicing either a boxing or martial arts technique, since the user will have to respond to the continuously rotating arm of the rotating target.

However, yet another operative feature of the rotating target is its intended restricted rotation through a rotational path of less than 360° or less than a complete circular path about the longitudinal axis of the shaft. Accordingly, the exercise and/or training assembly of the present invention further comprises a resistance assembly which is adjustably but fixedly secured in a predetermined location relative to the rotational path of one or more of a possible plurality of arms of one or more rotating targets. Therefore, the resistance assembly may be purposefully disposed in an "interruptive position" relative to the rotational path of the arm. As such rotation of the arm will be restricted and/or prevented from accomplishing a complete 360° arc of rotation.

Further, the resistance assembly may include a biasing or spring structure which is disposed to engage the arm during its rotation. In addition, the biasing structure is disposed and structured to direct a directional, biasing force on the rotating arm, which will not only stop its rotation, but force it to rotate in an opposite direction, back towards the user. More specifically, the biasing structure of the resistance assembly will exert a force on the rotating arm in a direction which is substantially opposite to the initial direction of rotation of the arm along its intended rotational path of travel. This will serve to redirect the rotating arm back towards the user. In turn, the user can appropriately react by purposefully "ducking" the returning rotating arm and or delivering an additional defensive blow thereto, dependent on the particular exercise or training activity which the user is practicing.

The versatility of the exercise assembly of the present invention is further demonstrated by the provision of a head target. The head target includes a support member which is preferably a rigid arm segment adjustably secured along the length of the shaft and thereby disposed at any preferred or appropriate height. A target section defines a distal end of the head target and is structured to be struck or receive a blow from the user. In addition, a spring segment is included in the head target and is disposed in movably, resiliently interconnecting relation between an outer end of the support arm segment and the inner or proximal end of the target section. Further, the spring segment may have a substantially conical configuration. As such, the conically configured spring extends divergently is corresponding outward in at least partially surrounding and/or gripping relation to the proximal end of the target section. Such structuring of the head target also facilitates its use as a "speed bag". In order to provide a more realistic appearance and disposition of the head target it may be disposed at an acute angle relative to the length of the shaft and be directed either upwardly or downwardly at such an acute angle.

The exercise assembly of the present invention may also include one or more fixed targets which may be similarly structured to the head target by the inclusion of a support arm segment, a target portion or section structured, to receive a blow from the user, and a resilient, spring segment. The spring element in both the head target and one or more fixed targets will be calibrated and/or otherwise structured to absorb the force of a blow exerted on the target section, but cause a return the target section to an original orientation. Such one or more fixed targets may be strategically or appropriately placed along the length of the support shaft at any one of a plurality of angles which facilitate the practice of any boxing, martial arts or like activities being performed by the user.

Yet additional features of the exercise assembly of the present invention includes an enhanced structuring of the base. As such, the base may be dimensioned and configured to support the shaft in an outwardly and/or upright orientation concurrently to allowing a user to stand on an exposed or outer surface or face of the base. Such positioning of the user is further facilitated by the inclusion of a slip-resistant and/or traction enhancing structure mounted on the outer exposed surface or face. Such a slip-resistant structure would be disposed so as to engage the feet of the user while practicing the intended exercise and or training activity. Other features of one or more additional embodiments of the base may include it being removably but fixedly attached to a supporting surface using any of a variety of connectors. Such connectors may include one or more adhesive type connectors or similarly structured connectors, attachment structures, etc. which allows the fixed positioning of the base on the supporting surface but also allows for its removal from the supporting surface, when not being used.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 17B is a detail view of a component of the embodiment of FIG. 17A.

Like reference numerals refer to like parts throughout the several views of the drawings.

DETAILED DESCRIPTION OF THE PREFERRED EMBODIMENT

Figure 1:
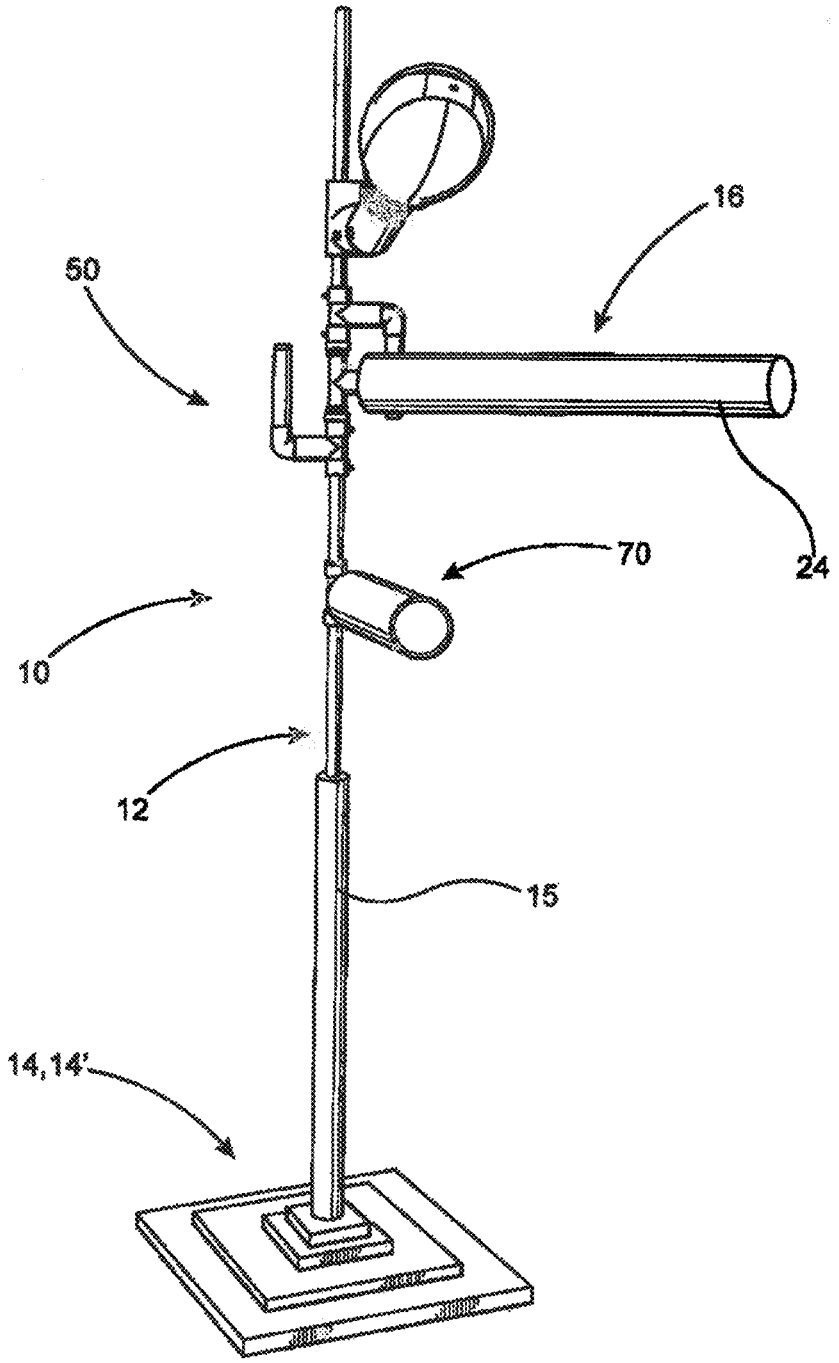
FIG. 1 is a perspective view of one preferred embodiment of an exercise assembly of the present invention.
Figure 2:
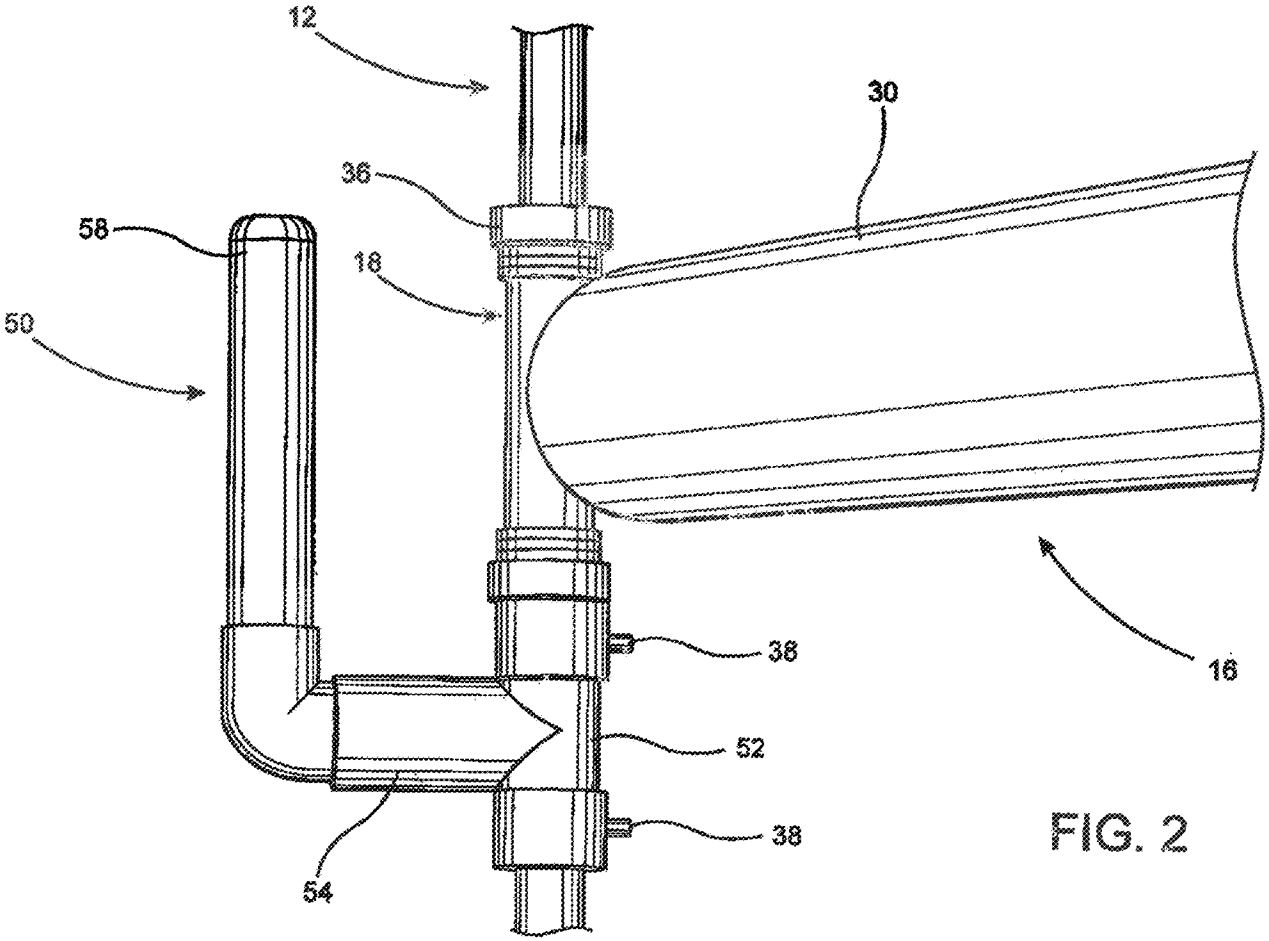
FIG. 2 is a perspective view in partial cutaway disclosing relative positions of the rotating target of the embodiment of FIG. 2 and a resistance assembly which may be cooperatively used therewith.

As represented in the accompanying Figures and with initial, reference to FIG. 1, the present invention is directed to a training assembly generally indicated as 10. The training assembly 10 includes sufficient structural and operative versatility to facilitate its use for both training and exercising. More specifically, the training assembly 10 includes an elongated support shaft or stanchion, generally indicated as 12. In cooperation therewith, a base 14, 14' may be fixedly or removably mounted on a supporting surface such as a floor, ground surface, etc. However, while the vertically upright operative orientation of the exercise assembly 10, as represented in FIG. 1, may be the most popular position of use, the support shaft 12 and cooperative, supporting base 14, 14' may be structured to be oriented in an "inverted orientation", such as by depending from a ceiling surface or extending transversely outward from a side wall or the like.

As also represented in FIG. 1, a reinforcing member 15 may be integrally connected to or otherwise associated with a lower portion of the shaft 12 so as to facilitate its support and mounting on the base 14, 14'. Such reliable mounting of the support shaft, as well as a plurality of target structures mounted thereon is important due to the fact that the support assembly 10 is intended to be repeatedly "struck" as a user performs various boxing, martial arts and/or like activities, while utilizing the exercise assembly 10.

As also represented in FIG. 1, the exercise and/or training assembly 10 includes a plurality of target structures, each of which is intended to receive repeated, forceful blows as the user performs the intended boxing, martial arts, etc. routine. More specifically and with primary reference to FIGS. 1 and 3, the exercise and/or training assembly 10 includes at least one but a possible plurality of rotating targets generally indicated as 16. As will be discussed in greater detail hereinafter, each of the one or more rotating targets 16 are rotationally connected to the support shaft 12 by a rotational fitting, generally indicated as 18, in FIGS. 3 and 5. With primary reference to FIG. 3, each of the one or more rotating targets 16 includes an elongated arm 24 including both a weighted construction generally indicated as 22 and a safety portion generally indicated as 28. The weighted portion 22 preferably comprises an elongated weighted, rigid material member 26, which may be in the form of a rigid material dowel.

As such, the member or dowel 26 extends substantially along at least a majority of the length of the arm 24 and intermediate opposite ends of the arm 24 or intermediate the rotational fitting 18 and the distal end 24' of the arm 24. While the length of the weighted member or dowel 26 may vary, one feature thereof includes the addition of a predetermined amount of weight to the arm 24 and/or rotating targets 16 which will facilitate its continuous rotation about the longitudinal axis of the shaft 12. More specifically and in at least one embodiment such a preferred weight of the arm 24 may be, but is not limited to, being in the range of between 13 and 14 ounces. This predetermined weight may vary depending on the overall structure of the rotating target 16. Further, the overall length of the arm 24 is preferably in the range of between 24 and 25 inches. As represented in FIG. 1 such an extended length of the rotating target 16 and corresponding arm 24 allows it to extend transversely outward from the shaft 12 a significantly greater distance than the other target structures. This extended length further provides a user of the exercise assembly 10 with a greater challenge due to the continuous rotation of the one or more rotating targets 16.

Each of the one or more rotating targets 16 also includes a safety portion 28 defining and extending along the length of the distal end, 24' inwardly towards the rotational fitting 18. The length and overall structure of the safety portion is such as to facilitate the receiving of any forceful blow delivered by the user. Accordingly, an outer end 26' of the weighted member or dowel 26 may be inwardly spaced from the safety portion 28 and the distal end 24' of the arm 24 a sufficient distance to assure that any blow delivered to the rotating target 16 will engage the safety portion 28. Further, the safety portion 28 is formed of a cushioning material such as, but not limited to, a resilient foam type of material which offers at least a predetermined minimal resistance to a blow or punch being thrown by a user. As such, there will be no chance of damage to the user's hand, arm, etc. by the delivery of such a blow to the safety portion 28.

Figure 3:
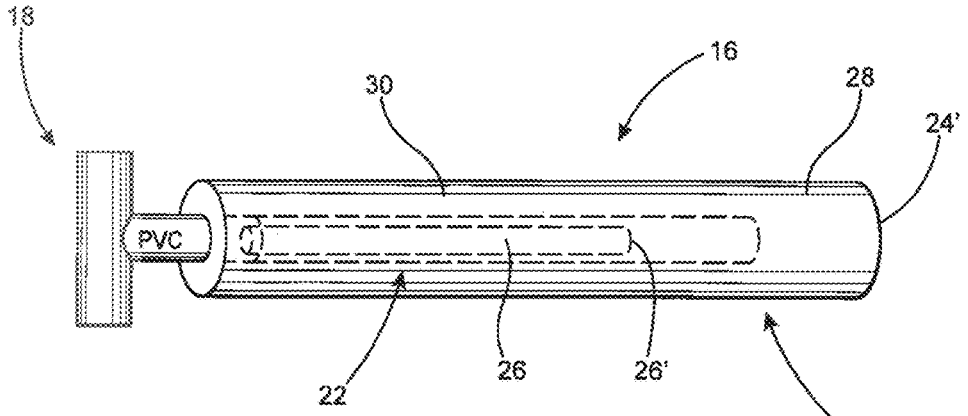
FIG. 3 is a perspective view in detail of a rotating target component of the embodiment of FIG. 1.
Figure 4:
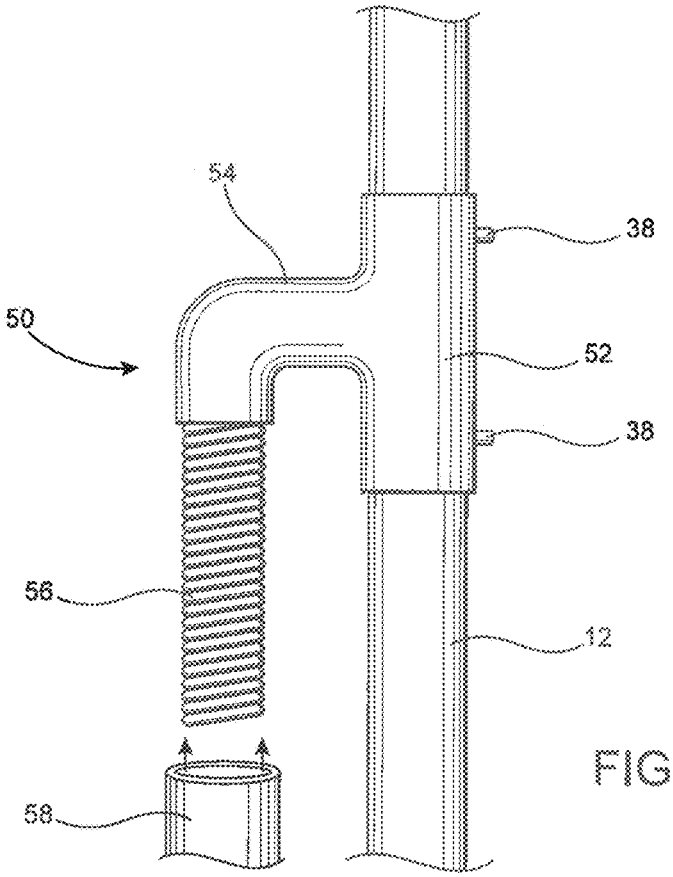
FIG. 4 is a detailed view in partial cutaway and exploded form disclosing structural details of the resistance assembly as represented in the embodiments of FIGS. 1 and 2.

However, the at least minimal, non-damaging resistance provided by the safety portion 28 is sufficient to cause the rotation of the arm 24, about the shaft 12 in the manner intended, when the safety portion 28 and arm 24 are being struck. Additional features which enhance the safety of striking the arm 24 includes the provision of an outer sleeve 30 extending along the length of the arm 24, or at least a majority thereof, in overlying, covering relation to the weighted member or dowel 26. As represented in FIG. 3, the safety portion 28 may in fact be an integrated part of the sleeve 30 since both the sleeve 30 and the safety portion 28 are formed of the aforementioned and described cushioning material such as a resilient foam material. However, it is emphasized that the safety portion 28 and the sleeve 30 may in fact be different structures, wherein the sleeve 30 overlies and covers the safety portion 28.

As also indicated, at least one preferred embodiment of the exercise assembly 10 includes the cooperative structuring of the arm 24 and the rotational fitting 18, such that the arm 24 continuously rotates about the shaft 12 at least 3 to 4 times when a typical blow or punch is delivered thereto by the user. Accordingly, and with primary reference to FIG. 5, the rotational fitting 18 comprises an elongated primary segment 32 having a hollow interior and an outwardly extending connecting segment 34. When disposed in its operative position, the primary portion 32 is disposed in concentrically surrounding relation to the shaft 12. As indicated the connecting segment 34 extends transversely outward therefrom in connected, supporting relation to a remainder of the arm 24 of the rotating target 16. Therefore, the rotational fitting 18 may include a substantially T-shape configuration.

Figure 3B:
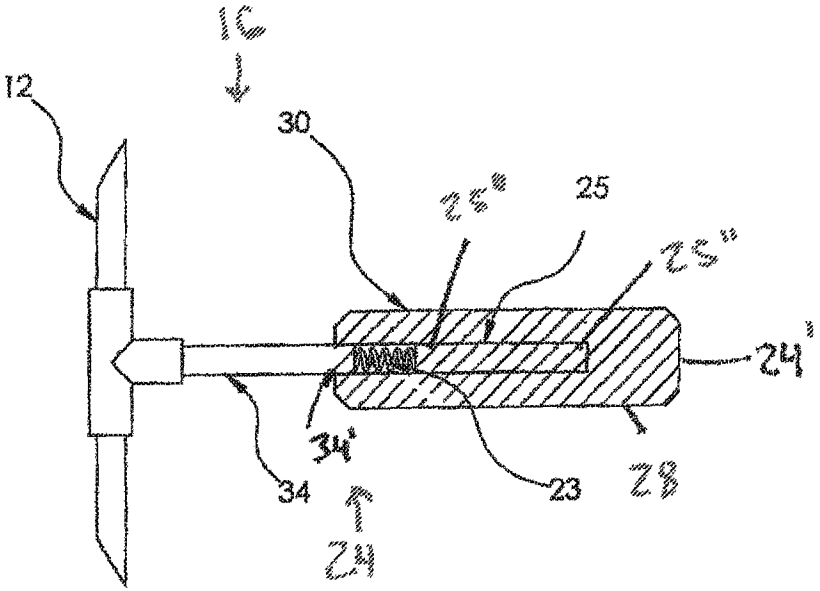
FIG. 3B is a perspective view in detail of another embodiment of the rotating target component of the embodiment of FIG. 1.
Figure 3A:
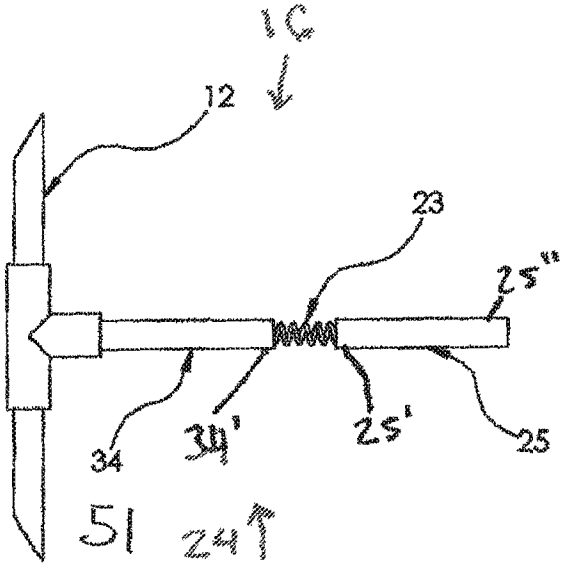
FIG. 3A is a perspective view in detail of a rotating target component of the embodiment of FIG. 3B.

In another embodiment, as illustrated in FIGS. 3A-3B, the elongated arm 24 may include an extension portion 25 and a biasing or spring portion 23 disposed in movably, resiliently interconnecting relation between the distal end 34' of the connecting segment 34 and a proximal end 25' of the extension portion 25. Further, as described above, the elongated arm 24 may include the safety portion generally indicated as 28.

The safety portion 28 may define and extend along the length of the distal end 24' of the arm 24, inwardly towards the rotational fitting 18. The length and overall structure of the safety portion 28 is such as to facilitate the receiving of any forceful blow delivered by the user. Accordingly, a distal end 25" of the extension portion 25 may be inwardly spaced from the safety portion 28 and the distal end 24' of the arm 24 a sufficient distance to assure that any blow delivered to the rotating target 16 will engage the safety portion 28.

The cooperative structuring of the biasing portion 23 and the connected extension portion 25 of the arm 24, may allow a user to deliver an uppercut type blow to the rotating target 16 when in the operative position 302. This may cause the biasing portion 23 to stretch or expand in an upward direction. This may cause the extension portion 25 and safety portion 28 of the arm 24 to at least partially pivot on an upwardly angular trajectory towards the shaft 12. Further, as described above, the elongated arm 24 may include the outer sleeve 30, extending along the length of the arm 24, or at least a majority thereof, in overlying, covering relation to the safety portion 28, extension portion 25, and the spring portion 23.

Figure 5:
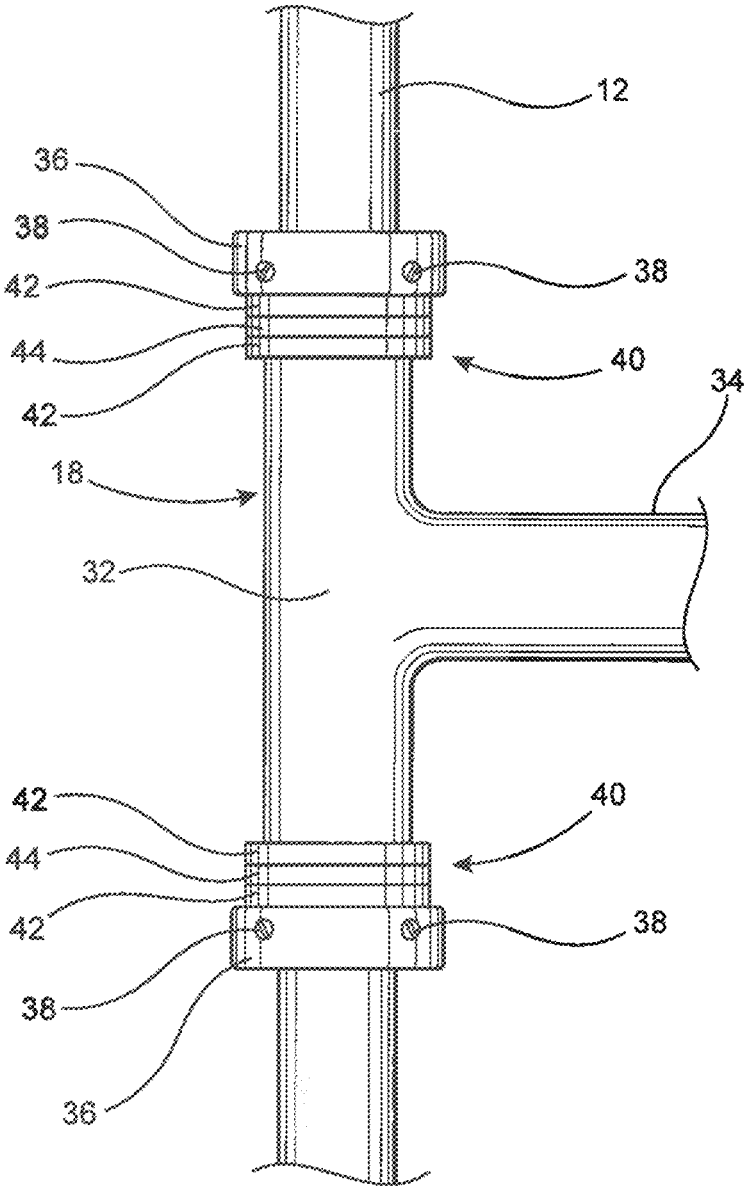
FIG. 5 is a detailed cutaway view of a rotational fitting used to secure and facilitate rotation of the rotating target of the embodiment of FIGS. 1 and 3 relative to the support shaft, in the manner represented in FIG. 1.

Further, the rotational fitting 18 is adjustably secured along the length of the shaft 12 using at least two, oppositely disposed locking collars 36 movably or adjustably connected to the shaft 12 by a plurality of set screws or like connectors 38. Associated with the rotational fitting 18 and operatively held in place by the locking collars 36 are two bearing assemblies generally indicated as 40. Each of the bearing assemblies 40 include two outwardly disposed washers 42 disposed in a sandwiching relation on opposite sides of a bearing structure 44, such as a thrust bearing or the like. As represented in FIG. 5 the locking collars 36 hold corresponding ones of the bearing assemblies 40 in an operative position relative to opposite open ends of the primary portion 32 of the rotational fitting 18. Therefore, rotation of the connecting segment 34 and the arm 24 of the rotating target 16 connected thereto is facilitated.

As emphasized above, one operative feature of the exercise and/or training assembly 10 is the challenge of the user to respond to the rotating target 16 and/or arm 24 as it continuously rotates a plurality of times about the length of the shaft 12. As further indicated this adds to the overall dexterity of the user and provides a more challenging workout.

However, yet another operative feature of the rotating target 16 is its intended "restricted rotation" through a rotational path of less than 360° or less than a complete circular path about the longitudinal axis of the shaft 12. Accordingly, at least one preferred embodiment of the exercise and/or training assembly 10 further comprises a resistance assembly 50 which is adjustably but fixedly secured to the shaft 12 by a fitting 52, utilizing one or more sets screws 38. More specifically, the resistance assembly 50 is disposed in a predetermined location relative to the rotational path of a corresponding one of a possible plurality of arms 24 of one or more rotating targets 16. Therefore, the resistance assembly may be purposefully disposed in an "interruptive position" relative to the rotational path of the arm 24. As such, rotation of the arm will be restricted and/or prevented from accomplishing a complete 360° arc of rotation.

Further, the resistance assembly 50 includes a support segment 54 which may be considered a part of the fitting 52 adjustably connected to the shaft 12. Also, the resistance assembly 50 includes a biasing or spring structure 56 which is disposed to engage the arm 24 during its rotation. For purposes of safety, the biasing or spring structure 56 may be covered by a sleeve member 58, which may also be formed of a cushioning material of the type described above and from which the safety portion 28 and the sleeve 30 of the arm 24 is formed. In addition, the biasing structure 56 is disposed and calibrated or otherwise structured to stop rotation of the arm 24 and deliver or impose a directional, biasing force on the rotating arm 24. Such a biasing force will not only stop the rotation of the arm 24, but force it to rotate in an opposite direction, back towards the user. More specifically, the biasing structure 56 of the resistance assembly 50 will exert a biasing force on the rotating arm 24 in a direction which is substantially opposite to the initial direction of rotation of the arm 24 along its intended rotational path of travel. This will serve to reverse and redirect the rotation of the arm 24 back towards the user. In turn, the user can appropriately react by purposefully "ducking" the returning rotating arm 24 and or delivering an additional defensive blow thereto, dependent on the particular exercise or training activity which the user is practicing. It should be noted that a plurality of such resistance of assemblies 50 may be utilized with correspondingly disposed ones of a plurality of rotating target 16.

Figure 6:
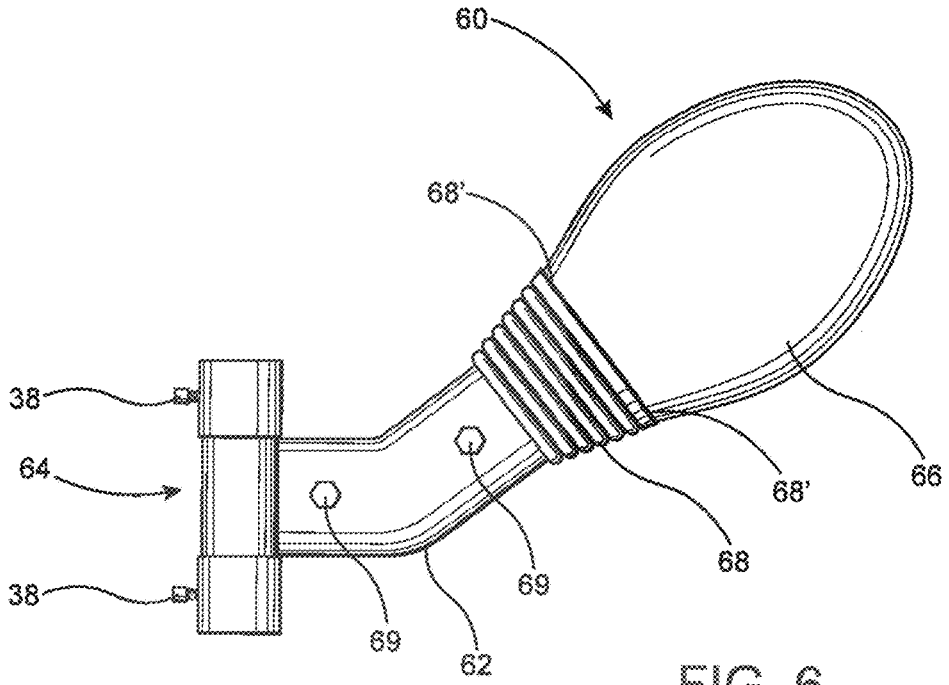
FIG. 6 is a side detail view of a head target also represented in an operative position in FIG. 1.
Figure 7:
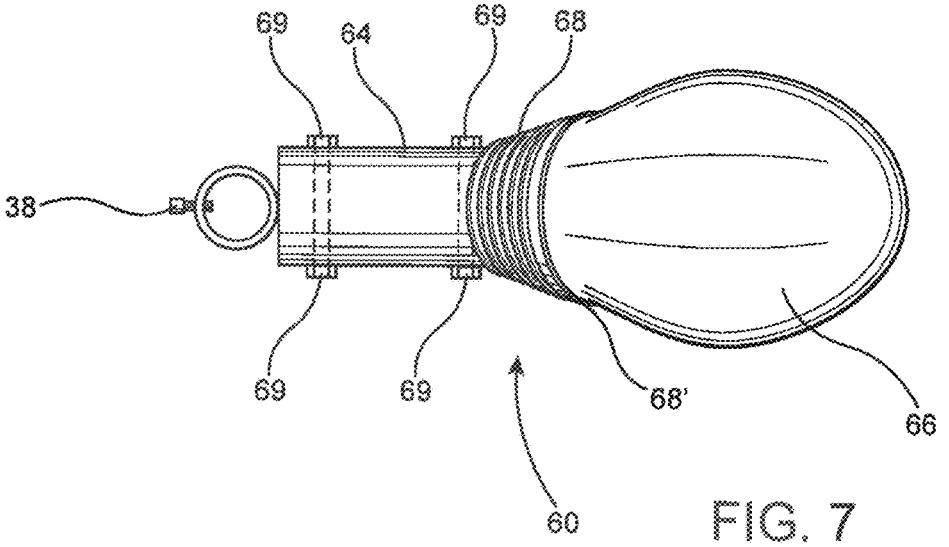
FIG. 7 is a top view of the embodiment of FIG. 6.

As represented in FIGS. 1, 6 and 7 the versatility of the exercise assembly of the present invention is further demonstrated by the provision of a head target 60. The head target 60 includes a support member which is preferably a rigid arm segment 62 adjustably secured along the length of the shaft 12 by fitting 64. The fitting 64 is intended to adjustably but fixedly dispose the head target 60 at a predetermined or preferred location along the length of the shaft 12 and at a preferred or appropriate height. The height and/or position of the head target 60 along the length of the shaft 12 may be dependent on the height or stature of the user or, as set forth above, the particular activity being practiced by the user.

Accordingly, the head target 60 includes a target section 66 which defines a distal or outer end of the head target 60. The target section is structured to be struck or receive a blow from the user. In addition, a spring segment 68 is included as part of the head target 60 and is disposed in movably, resiliently interconnecting relation between the support arm segment 62 and the inner or proximal end of the target section 66. Further, the spring segment 68 may have a substantially conical configuration, which serves to enhance the support of the target section 66 and maintain it in a preferred orientation or position.

As such, the conically configured spring 68 extends divergently outward such that the larger and more open end thereof 68' is disposed in at least partially surrounding and/or gripping relation to the proximal end of the target section 66, as clearly represented in FIGS. 6 and 7. The specific dimension, configuration and overall structuring of the head structure 60 may vary and as such may require the use of one or more connectors 69 serving to securely but appropriately connect the target section 66 to the outer end of the support segment 62 in combination with the operative placement of the spring structure 68. Such structuring of the head target 60 also facilitates its use as a "speed bag" in a conventional manner in which such speed bags are used. In order to provide a more realistic appearance and disposition of the head target 60 and make it more "available" to receive repeated blows or punches from a user, it may be disposed at an acute angle relative to the length of the shaft 12 and be directed either upwardly or downwardly at such an acute angle.

As represented in FIG. 1, at least one preferred embodiment of the exercise assembly 10 also include one or more fixed targets 70 which may be similarly structured as the head target 60. More specifically, each of the one or more fixed targets 70 may include a support arm segment 62, a target portion or section 66 structured, to receive a blow from the user. Also, each of the one or more fixed targets 70 may be fixedly but adjustably secured to the shaft 12 by fitting 64. Further, in order to facilitate the target section 66 absorbing a plurality of blows or punches, a resilient, spring segment 68 may also serve to interconnect the target section 66 with the support segment 62, of the one or more fixed targets 70. Moreover, the spring element in both the head target 60 and one or more fixed targets 70 will be calibrated and/or otherwise structured to absorb the force of a blow exerted on the target section 66, but cause a return the target section 66 to an original outwardly extending orientation as represented in the Figures. Also, as with the head target 60, the structural components of the each of the fixed targets 70, as set forth above, are such as to absorb a punch or blow from the user in a manner which does not cause a displacement and/or rotation of the fixed targets 70 about the shaft 12. Further, the one or more fixed targets 70 may be strategically or appropriately placed along the length of the support shaft 12 at any one of a plurality of outwardly extending directions, which facilitate the practice of any boxing, martial arts or like activities being performed by the user. As also represented in FIG. 1 each of the one or more fixed targets 70 may have an elongated substantially linear configuration rather than the acutely angled configuration of the head target 60.

Figure 8:
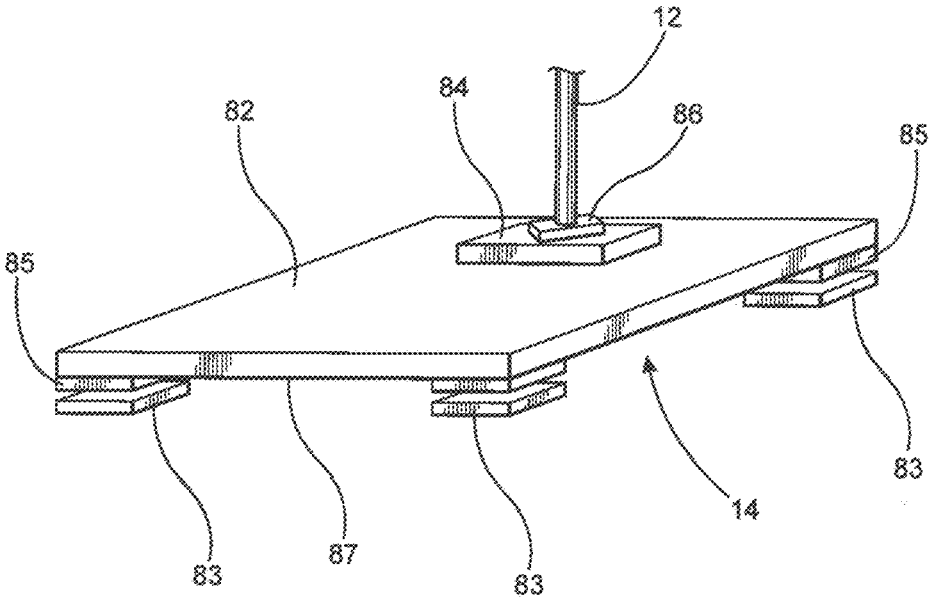
FIG. 8 is a perspective view in partial cutaway of one embodiment of a base in accord with the embodiment of FIG. 1.
Figure 9:
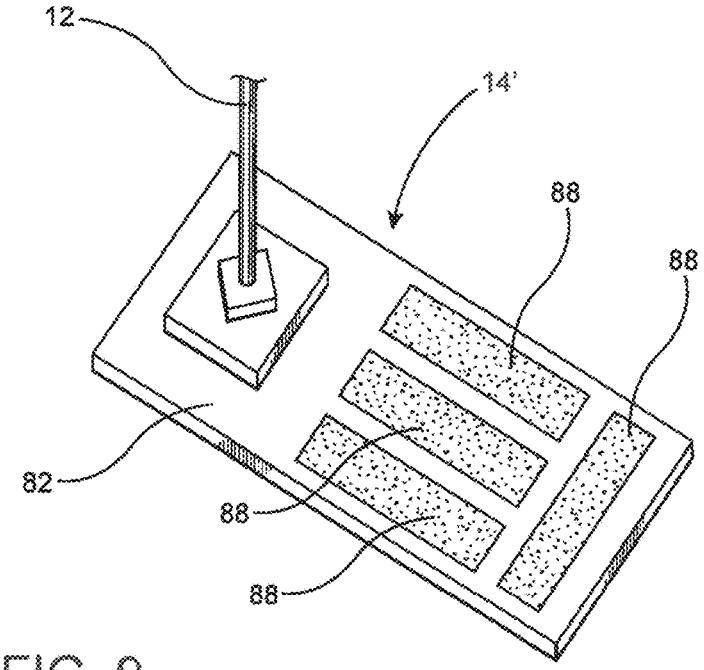
FIG. 9 is a perspective view in partial cutaway of yet another preferred embodiment of the base.

With primary reference to FIGS. 8 and 9, the aforementioned base 14 and 14' are provided to support the shaft 12 in an upright and/or other outwardly extending orientation relative thereto. In at least one preferred embodiment as represented in FIG. 8, the base 14 includes a substantially planar platform having an outer face or surface 82. The support shaft 12 is removably or fixedly connected to the base 14 and may include a plurality of supplementary supports in the form of plates, blocks, levels, etc. 84 and 86 disposed in engaging, supporting relation to the corresponding end of the shaft 12. More specifically, at least two supplementary supports or levels 84, 86 may be required in order to properly support the corresponding end of the shaft 12. Such support may be considered frequently necessary due to the plurality of target structures, as set forth above, receiving repeated blows or punches from a user. In another embodiment, the base 14, 14' and/or the supplementary levels 84, 86 may include a level with indicating bubbles so as to facilitate the proper orientation of the shaft 12 relative to a supporting surface.

As also represented in FIG. 8, the base 14 may be removably secured to a supporting surface such as a floor or the like. In doing so, a plurality of mounting members 83 may be fixedly or removably secured to the corresponding support surface and be disposed in an orientation so as to be removably connected to corresponding mounting structures 85 formed on the under face or under surface 87 of the base 80. Interconnection between the mounting members 83 and 85 may be accomplished by an appropriate adhesive material or other sufficiently strong connecting structures to maintain the stability of the base 14 while in use.

As represented in FIG. 9, yet another preferred embodiment of the base is represented as 14'. In this embodiment, the planar platform is sufficiently dimensioned and configured to have a user being supported on an outer face or surface 82 thereof. As such, the base 14' is structured to support the shaft in an outwardly and/or upright orientation concurrently to allowing the user to stand on the exposed or outer surface or face 82 of the base 14'. Such positioning of the user is further facilitated by the inclusion of a slip-resistant and/or traction enhancing structure 88 mounted on the outer exposed surface or face 82. Such a slip-resistant structure 88 may comprise a single segment or, as represented in FIG. 9A plurality of segments. In either structural variation, the slip-resistant structure 88 would be disposed so as to engage the moving feet of the user, while practicing the intended exercise and or training activity.

Figure 10:
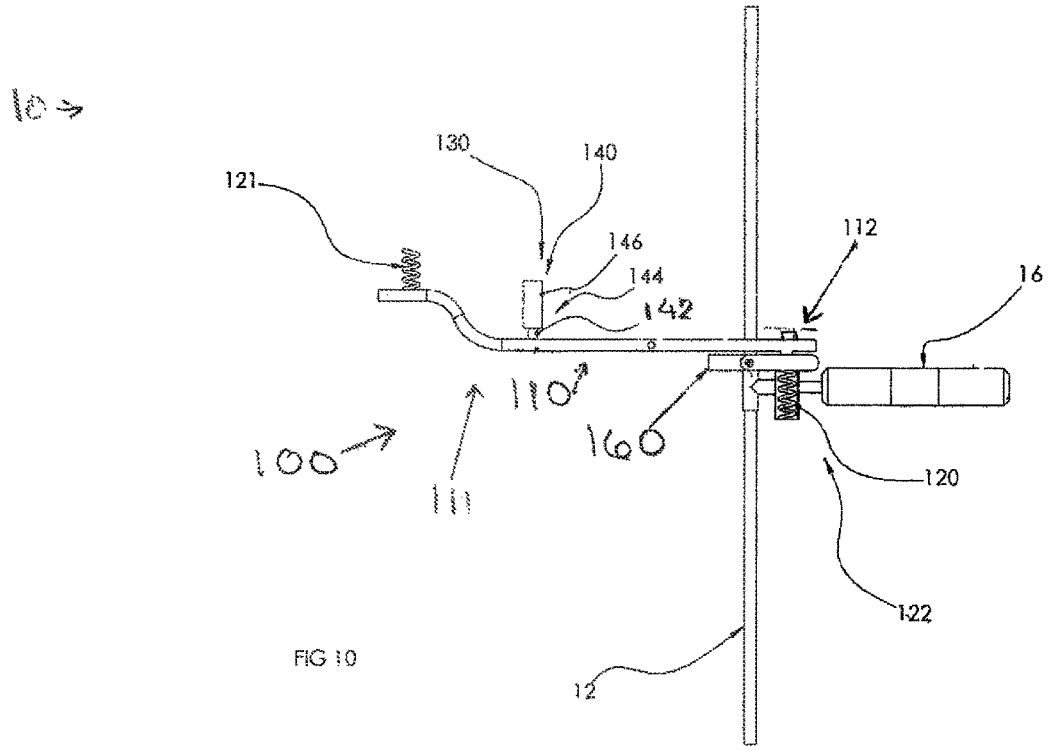
FIG. 10 is a perspective view of another preferred embodiment of an exercise assembly of the present invention.

However, yet another operative feature of the rotating target 16 is its intended "intermittent restricted rotation" through a rotational path of less than 360° or less than a complete circular path about the longitudinal axis of the shaft 12. As such, and as described in greater detail hereinafter, rotation of the arm will be intermittently or randomly restricted and prevented from accomplishing a complete 360° arc of rotation. Accordingly, and as represented in FIG. 10, another preferred embodiment of the training assembly 10 further comprises a solenoid-arm assembly generally indicated as 100. The solenoid-arm assembly 100 includes sufficient structural and operative versatility to facilitate its use while used in combination with the one or more rotating targets 16 as described above. The solenoid-arm assembly 100 may restrict the rotation of the rotating target 16 to a rotational path of less than 360° about the longitudinal axis of the shaft 12. More specifically, the solenoid-arm assembly 100 may be disposed in a predetermined location relative to the rotational path of the corresponding rotating target 16. Therefore, the solenoid-arm assembly 100 may be purposefully disposed in an interruptive position relative to the rotational path of the rotating target 16. As such, rotation of the rotating target 16 may be restricted and/or prevented from accomplishing a complete 360° arc of rotation about the shaft 12.

Additionally, the solenoid-arm assembly 100 includes a pivot arm 110 operatively positioned so as to pivot into and out of an interruptive position relative to the rotational path of the rotating target 16. As such, the pivot arm 110 includes a lower biasing structure 120 which defines a distal or outer end of the pivot arm 110. The lower biasing structure 120 is disposed to engage the rotating target 16 during its rotation, when in the active orientation 122, as explained in greater detail hereinafter. The lower biasing structure 120 is calibrated or otherwise structured to stop the rotation of the rotating target 16 and deliver or impose a directional biasing force on the rotating target 16. Such a biasing force will not only stop the rotation of the rotating target 16, but force it to rotate in an opposite direction, back towards the user. More specifically, the lower biasing structure 120 will exert a biasing force on the rotating target 16 in a direction which is substantially opposite to the initial direction of rotation of the rotating target 16 along its intended rotational path of travel. This will serve to reverse and redirect the rotation of the rotating target 16 back towards the user. In turn, the user can appropriately react by purposefully side-stepping the returning rotating target 16 and/or deliver an additional blow thereto, dependent on the particular exercise or training activity which the user is practicing. It should be noted that a plurality of such solenoid-arm assemblies 100 may be utilized with correspondingly disposed ones of a plurality of rotating targets 16. Further, the pivot arm 110 includes a top biasing structure 121 which defines a proximal or inner end of the pivot arm 110. The top biasing structure 121 is structured to expedite the positioning of the lower biasing structure 120 into the active orientation 122.

Additionally, as described above, the solenoid-arm assembly 100 will restrict the rotation of the rotating target 16 when the lower biasing structure 120 is in the active orientation 122. As such, the solenoid-arm assembly 100 includes an activation mechanism 130 structured to randomly position the lower biasing structure 120 between the active orientation 122 and an idol orientation 123. When the lower biasing structure 120 is in the active orientation 122 it is positioned into an interruptive position relative to the rotational path of the rotating target 16. More specifically, the transversely extending rotating target 16 will engage the lower biasing structure 120 during its rotation about the shaft 12. However, when the lower biasing structure 120 is in the idol orientation 123 it is positioned into a non-interruptive position relative to the rotational path of the rotating target 16.

Figure 10A:
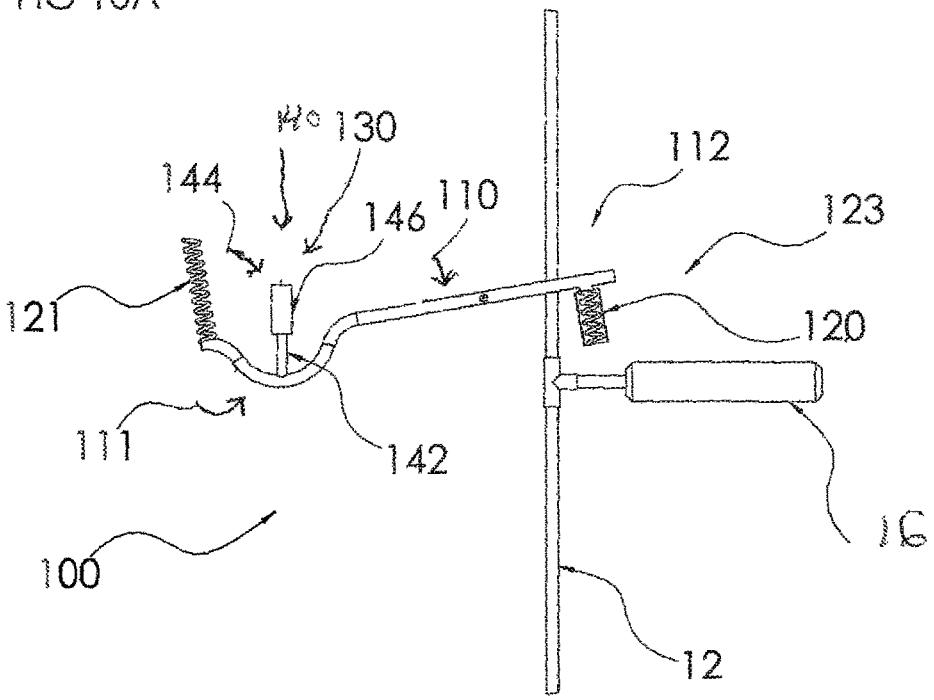
FIG. 10A is a perspective view of the embodiment of FIG. 10 in a different operative orientation.

Further, the activation mechanism 130 comprises a solenoid 140 mounted towards the proximal end of the pivot bar 110 and structured to position the lower biasing structure 120 between the active orientation 122 and the idol orientation 123. Further, with primary reference to FIG. 10A, the solenoid 140 includes a solenoid bar or plunger 142 structured to randomly engage the proximal end of the pivot bar 110. Additionally, the activation mechanism 130 further comprises a time switch mechanism 146 structured to intermittently or randomly electrically activate the solenoid 140. As such, when the solenoid 140 is electrically activated by the time switch mechanism 146, the solenoid bar 142 will release from the interior of the solenoid 140. This will serve to exert a biasing force on the proximal end of the pivot arm 110 in a direction opposite the lower biasing structure 120. More specifically, the exertion of the biasing force will force the proximal end of the pivot bar 110 in a downward direction, while concurrently forcing the distal end in an upward direction. This will serve to position the lower biasing structure 120 into the idol orientation 123 above the orbit of the corresponding rotating target 16. The random electrical activation of the solenoid 140 is indeterminate and may range from a split second to many seconds. As further indicated this intermittent interference with the rotation of the rotating target 16, reversing direction unpredictably, adds to the overall dexterity of the user and provides a more challenging workout.

Further, when the solenoid 140 is electrically activated again by the time switch mechanism 146, the lower biasing structure 120 will be positioned in the active orientation 122. More specifically, the pulsing of the solenoid 140 will retract the solenoid bar 142 into the interior of the solenoid 140. As such, this will return the pivot bar 110 to its original position. This will serve to position the lower biasing structure 120 into the active orientation 122 directly into the orbit of the rotating target 16. In addition, when the lower biasing structure 120 is disposed in the active orientation 122, the rotating target 16 will engage the lower biasing structure 120 and orient the rotating 16 target from the inoperative position 150 into the operative position 151. As such, when the rotating target 16 is disposed in the operative position 151 the user may again deliver a blow thereto, causing it to rotate about the shaft 12 returning it into the inoperative position 150 away from the user.

Figure 10B:
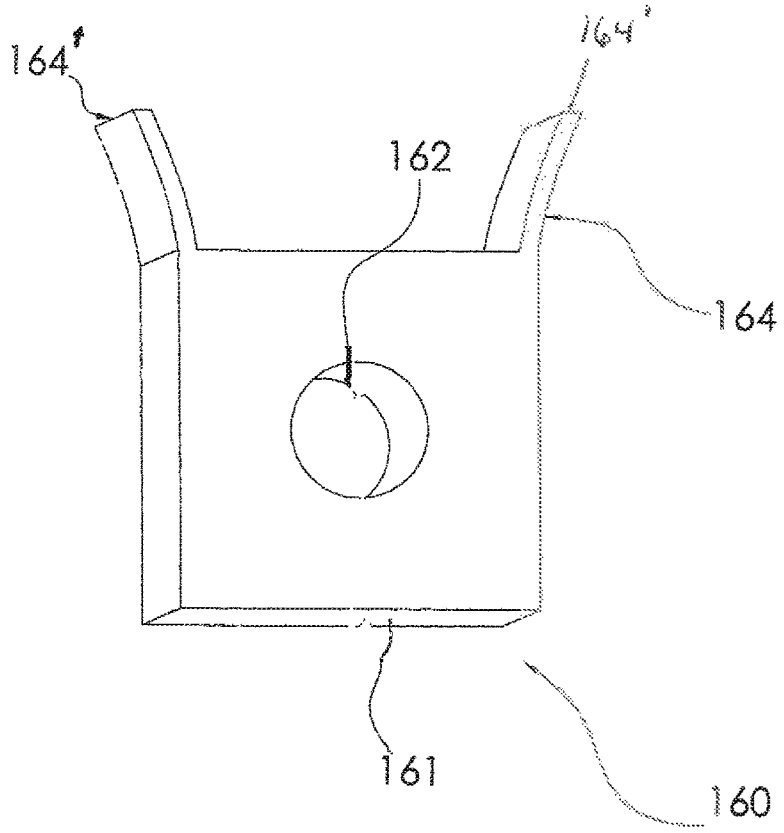
FIG. 10B is a Perspective, Detail View of a Component of the Embodiment of FIGS. 10 and 10A.

Further, with primary reference to FIG. 10B, the solenoid-arm assembly 100 includes a guide mechanism 160, which is adjustably but fixedly secured to the shaft 12. More specifically, the guide mechanism 160 includes a mounting block or like member 161, which may include an aperture 162 for the receipt and/or connection to the support shaft 12. In addition, the guide mechanism 160 includes at least two, spaced apart arm members 164 preferably including an opening or spacing at their outer or distal ends 164'. Accordingly, the guide mechanism 160 is structured to prevent the lower biasing structure 120 from moving in a direction beyond the active orientation 122. More specifically, when the lower biasing structure 120 is oriented into the active orientation 122, it will pass through and between the arm members 164 into the active orientation 122. The guide mechanism 160, including, but not limited to, the arm members 164 will engage the distal end of pivot arm 110 positioning it such that the pivot arm 110 extends transversely outward relative the shaft 12. As such, when the lower biasing structure 120 is in the active orientation 122, the rotating target 16 will engage the lower biasing structure 120 during its rotation. In turn, the lower biasing structure 120 will absorb the force of the rotating target 16 on contact and exert that driving force back onto the rotating target 16 in an opposite direction. This will cause a return of the rotating target 16 to the operative position 151. When the lower biasing structure 120 is forced back into the idol orientation 123, the lower biasing structure 120 will again pass back through and between the arms 164 and possibly through the open, spaced apart outer ends 164'.

Further, in at least one embodiment, a preferred length of the lower biasing structure 120 may be, but is not limited to, being 5 inches. As represented in FIG. 10 such a preferred length of the lower biasing structure 120 allows it to extend such a distance that the rotating target 16 will engage the lower biasing structure 120, but will not interfere with any other targets of the training assembly 10. As such, there will be no chance of damage to the pivot arm 110 or guide mechanism 160 by the delivery of such a blow from the rotating target 16.

Figure 11:
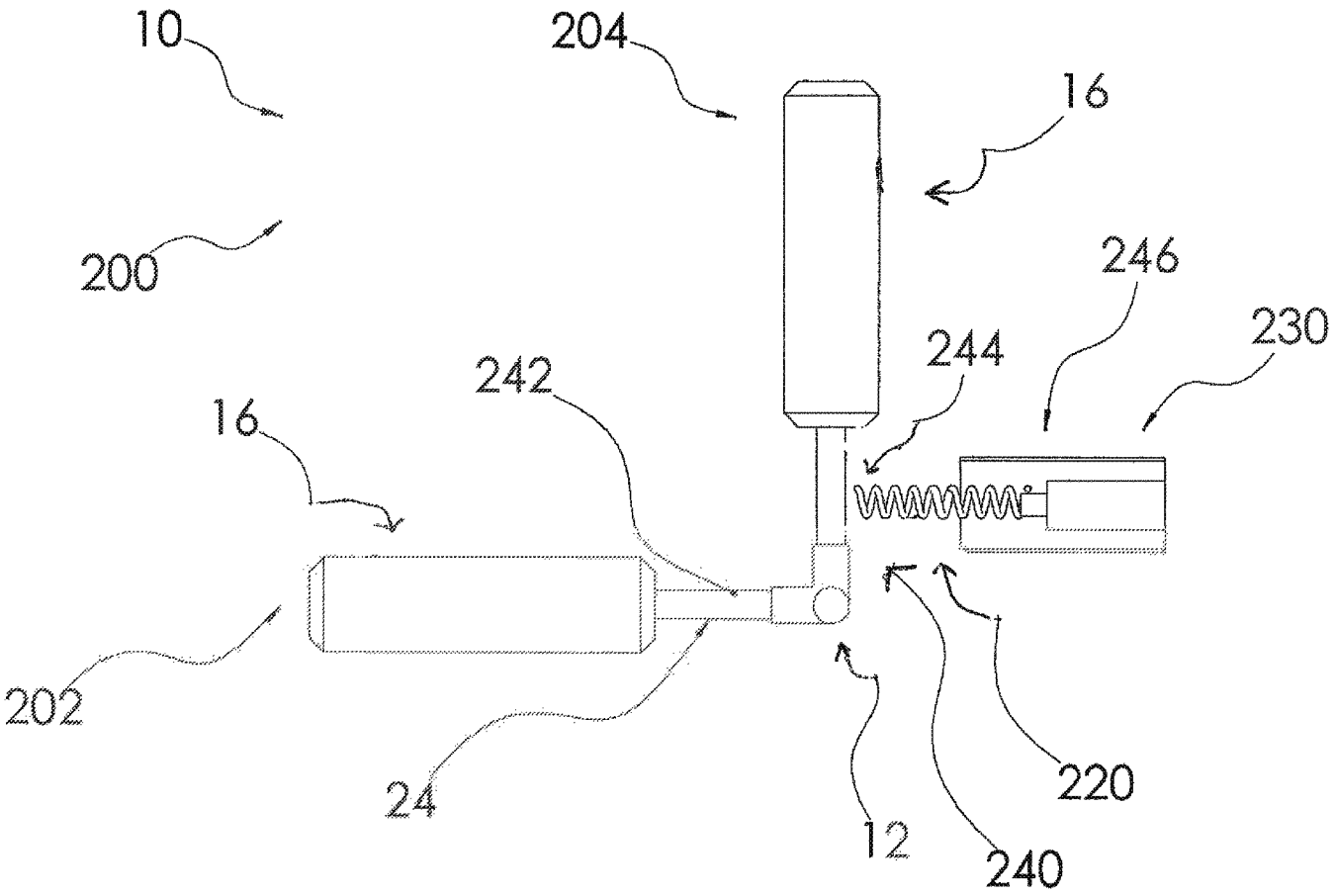
FIG. 11 is a top schematic view of another preferred embodiment of an exercise assembly of the present invention.

As represented in FIG. 11, another preferred embodiment of the training assembly 10 also includes a swing-arm assembly generally indicated as 200. The swing-arm assembly 200 includes sufficient structural and operative versatility to facilitate its use in combination with a target that can rotate around the support shaft 12 on contact from the user such as, but not limited to, the one or more rotating targets 16 as described above. Accordingly, for purposes of clarity and without limiting the scope of the present invention, the structural features of this invention will be described with reference to such a target being in the form of the one or more rotating targets 16 of the type represented in FIGS. 1, 2, 3, and 5. However, it is emphasized that the swing-arm assembly 200 of the present invention can be operable in combination with a variety of different types of targets that can rotate around the shaft 12 on contact from the user, in addition to and other than, the one or more rotating targets 16.

The swing-arm assembly 200 has an intended restricted rotation of the one or more rotating targets 16 through a rotational path of less than 360° or less than a complete circular path about the longitudinal axis of the shaft 12. More specifically, the swing-arm assembly 200 is disposed in a predetermined location relative to the rotational path of a corresponding one or more rotating targets 16. Additionally, the swing-arm assembly 200 includes an activating system 230 comprising an arm magnet 242 disposed on the arm 24 of the rotating target 16 and a corresponding assembly magnet 244 disposed on the activating system 230. As described in greater detail hereinafter, the activating system 230 is structured to dispose the rotating target 16 between an operative position 202 and an inoperative position 204. In one preferred embodiment of the training assembly 10, such a magnetic connection between the arm magnet 242 and the corresponding assembly magnet 244 may be, but is not limited to, an electromagnet.

Further, when the rotating target 16 is in the operative position 202 the user may deliver a blow thereto causing it to rotate on the shaft 12 in a direction away from the user, as indicated by direction arrow 241. During its rotation away from the user, the arm magnet 242 will magnetically engage the assembly magnet 244 disposing the rotating target 16 in the inoperative position 204 for an indeterminate amount of time. The rotating target 16 will remain in the inoperative position 204 until the magnetic connection between the arm magnet 242 and the assembly magnet 244 is activated. As such, the activating system 230 includes a time switch mechanism 246 structured to intermittently break the magnetic connection between the arm magnet 242 and the assembly magnet 244. More specifically, when the arm magnet 242 is in a magnetic engaging relation with the assembly magnet 244, the time switch mechanism 246 will randomly break the magnetic connection. The random discharge cycle, and subsequent release of the rotating target 16, is indeterminate and may range from a split second to many seconds. As further indicated this adds to the overall dexterity of the user and provides a more challenging workout.

As such, the swing-arm assembly 200 is structured to interrupt the rotation of the rotating target 16, dispose it in the inoperative position 204, and as described in greater detail hereinafter, deliver a biasing force to the rotating target 16 when the magnetic connection is activated. Such a force will force the rotating target 16 to rotate in an opposite direction towards the user, orienting the rotating target 16 back in the operative position 202 where the user may again deliver a blow or duck the returning rotating target 16.

Further, the swing-arm assembly 200 includes a biasing or spring structure 220 disposed to engage the arm 24 of the rotating target 16. The spring structure 220 is calibrated or otherwise structured to be constricted by the arm 24, when the arm magnet 242 is in a magnetic engaging relation with the assembly magnet 244. More specifically, when the arm magnet 242 is in a magnetic engaging relation with the assembly magnet 244, the arm 24 is held against the spring structure 220 maintaining it in a constricted state. However, when the magnetic connection between the arm magnet 242 and the assembly magnet 244 is activated by the time switch mechanism 246, the spring structure 220 is released back to its original non-constricted form. This expansion of the spring structure 220 creates a force which is exerted against the arm 24 of the rotating target 16. As such, the spring structure 220 delivers a directional biasing force on the arm 24 that will force the rotating target 16 to rotate in an opposite direction. More specifically, the spring structure 220 will exert a biasing force on the arm 24 in a direction which is substantially opposite to the initial direction of rotation of the rotating target 16 along its intended rotational path of travel. This will serve to reverse and redirect the rotation of the rotating target 16 back towards the user into the operative position 202. In turn, the user can appropriately react by purposefully ducking the returning rotating target 16 and/or delivering an additional blow thereto, dependent on the particular exercise or training activity which the user is practicing.

Figure 12:
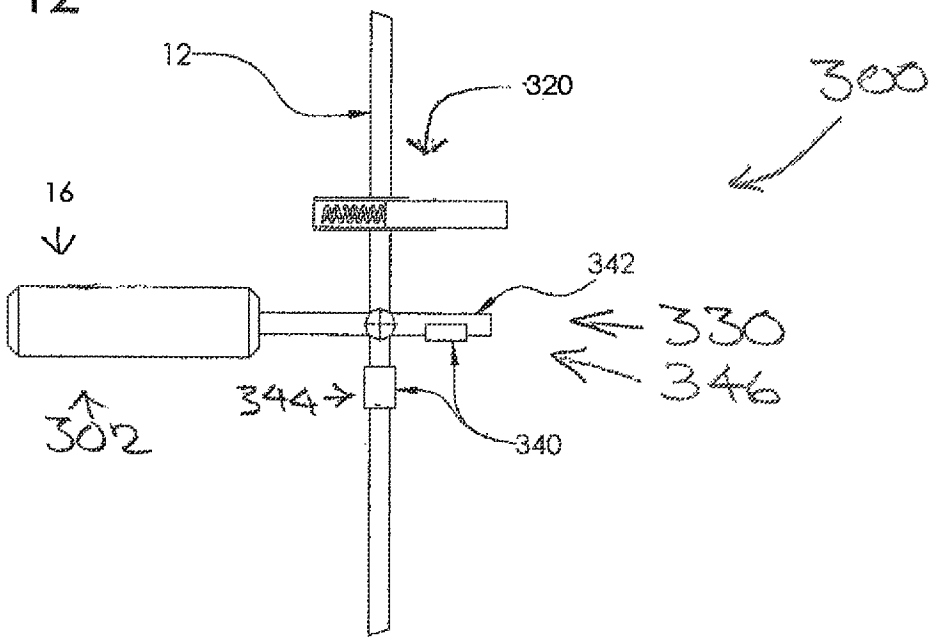
FIG. 12 is a schematic side view in partial cutaway of another preferred embodiment of an exercise assembly of the present invention.

As represented in FIG. 12, another preferred embodiment of the training assembly 10 includes a pivot swing-arm assembly generally indicated as 300. The pivot swing-arm assembly 300 includes sufficient structural and operative versatility to facilitate its use in combination with a target that can rotate around the support shaft 12 such as a rotating target 16, as described above. However, a rotating target with the additional capability to pivot between a transverse orientation relative to the shaft 12 and an acute angular orientation or an aligned and/or substantially parallel relation relative to the shaft 12, as indicated by directional arrow 341. More specifically, and as described in greater detail hereinafter, after an uppercut type of blow or punch from the user, the rotating target 16 may pivot between an upward acute angular orientation or an aligned and/or substantially parallel orientation relative the shaft 12. Accordingly, for purposes of clarity and without limiting the scope of the present invention, the structural features of this embodiment will be described with reference to a pivot swing-arm assembly 300 which can be operable in combination with a variety of different types of targets that can rotate around the shaft 12 and pivot as described above.

The pivot swing-arm assembly 300 may have an intended restricted rotation of a rotating target through a rotational path of less than 360° or less than a complete circular path about the longitudinal axis of the shaft 12. More specifically, the pivot swing-arm assembly 300 is disposed in a predetermined location relative to the rotational path of a corresponding rotating target 16. Additionally, the pivot swing-arm assembly 300 includes an activating system 330 comprising an arm magnet 342 disposed on the arm 24 of the rotating target 16 and a corresponding assembly magnet 344 disposed on the activating system 330. As described in greater detail hereinafter, the activating system 330 is structured to dispose the rotating target 16 between an operative position 302 and an inoperative position 304. In one preferred embodiment of the training assembly 10 such a magnetic connection between the arm magnet 342 and the corresponding assembly magnet 344 may be, but is not limited to, an electromagnet.

Further, when the rotating target 16 is in the operative position 302 the user may deliver an uppercut type blow to the rotating target 16 causing it to rotate and pivot on an upwardly angular trajectory towards the shaft 12. As such, during its upward trajectory, the arm magnet 342 will magnetically engage the assembly magnet 344 disposing the rotating target 16 in the inoperative position 304, and holding it for an indeterminate amount of time.

The rotating target will remain in the inoperative position 304 until the magnetic connection between the arm magnet 342 and the assembly magnet 344 is activated. As such, the activating system 330 includes a time switch mechanism 346 structured to intermittently break the magnetic connection between the arm magnet 342 and the assembly magnet 344. More specifically, when the arm magnet 342 is in a magnetic engaging relation with the assembly magnet 344, the time switch mechanism 346 will randomly break the magnetic connection. As such, the rotating target 16 will pivot back to its original transverse orientation, and rotate back towards the user as described below. The random discharge cycle is indeterminate and may range from a split second to many seconds. As further indicated this adds to the overall dexterity of the user and provides a more challenging workout.

The pivot swing-arm assembly 300 is structured to interrupt the rotation of the rotating target 16, dispose it in the inoperative position 304, and as described in greater detail hereinafter, deliver a biasing force thereto when the magnetic connection is activated. Such a force will force the rotating target 16 to rotate in an opposite direction toward the user, orienting the rotating target 16 back into an operative position 302 where the user may again deliver a blow thereto.

As such, the pivot swing-arm assembly 300 includes a biasing or spring structure 320 disposed to engage the arm 24 of the rotating target 16. The spring structure 320 is calibrated or otherwise structured to be constricted by the arm 24 when the arm magnet 342 is in a magnetic engaging relation with the assembly magnet 344. More specifically, when the arm magnet 342 is in a magnetic engaging relation with the assembly magnet 344, the arm 24 of the rotating target 16 is held against the spring structure 320, maintaining it in a constricted state. However, when the magnetic connection between the arm magnet 342 and the assembly magnet 344 is activated by the time switch mechanism 346, the spring structure 320 is released back to its original non-constricted form. This expansion of the spring structure 320 creates a force which is exerted back against the arm 24 of the rotating target 16. As such, the spring structure 320 delivers a directional biasing force on the arm 24 that will force the rotating target 16 to rotate in an opposite direction. More specifically, the spring structure 320 will exert a biasing force on the arm 24 in a direction which is substantially opposite to the initial direction of rotation of the rotating target 16 along its intended rotational path of travel. This will serve to reverse and redirect the rotation of the rotating target 16 back towards the user into the operative position 302. In turn, the user can appropriately react by purposefully ducking the returning rotating target and/or delivering an additional blow thereto, dependent on the particular exercise or training activity which the user is practicing.

Figure 13A:
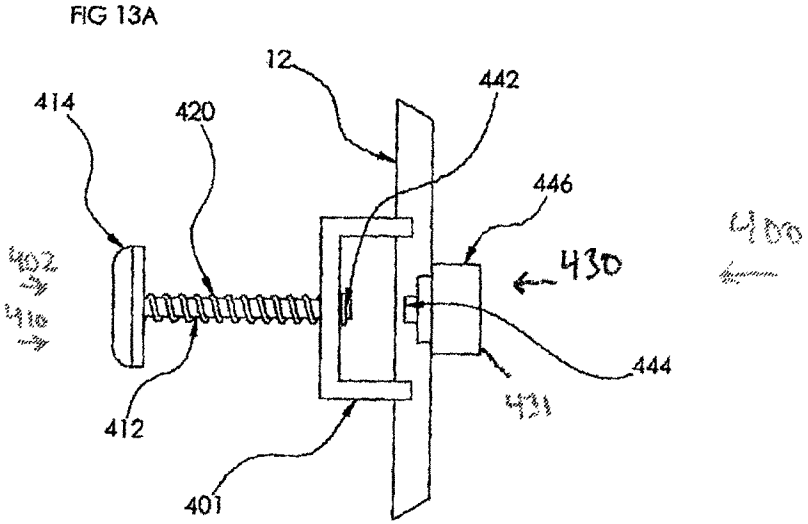
FIG. 13A is a perspective view of the embodiment of FIG. 13 in a different operative orientation.
Figure 13:
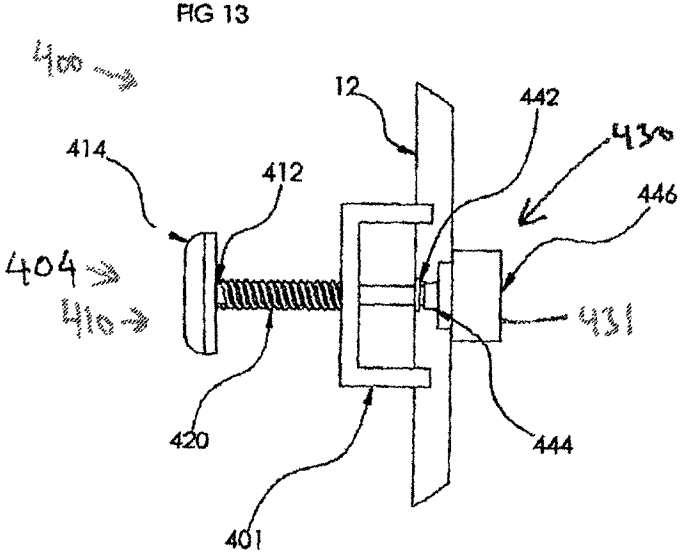
FIG. 13 is a perspective view of another preferred embodiment of an exercise assembly of the present invention in one operative orientation.

As represented in FIGS. 13 and 13A, another preferred embodiment of the training assembly 10 includes a spring-arm assembly generally indicated as 400. The spring-arm assembly 400 includes a bracket 401 adjustably mounted on the shaft 12, structured to support a retractable spring target 410. The spring target 410 includes a support arm section 412 and a target portion or section 414 structured to receive a blow from the user, when in an operative orientation 402. The structural components of each of the spring targets 410, as set forth above, are such as to absorb a punch or blow from the user in a manner which does not cause a rotation of the spring target 410 relative to support shaft 12. As described in further detail hereinafter, the spring target 410 will be positioned between a retracted inoperative orientation 404 and the transversely or outwardly extended operative orientation 402, relative to support shaft 12. Further, one or more spring-arm assemblies 400 may be strategically or appropriately placed along the length of the shaft 12 at any one of a plurality of outwardly extending directions, which facilitate the practice of any boxing, martial arts or like activities being performed by the user.

Additionally, the spring-arm assembly 400 includes an activating system 430 comprising an arm magnet 442 disposed on the support arm segment 412 and a corresponding assembly magnet 444 disposed on the activating system 430.

As described above, the activating system 430 is structured to position the spring target 410 between the operative position 402 and the inoperative position 404. In one preferred embodiment of the training assembly 10 such a magnetic connection between the arm magnet 442 and the corresponding assembly magnet 444 may be, but is not limited to, an electromagnet. Further, when the spring target 410 is in the operative position 402 the user may deliver a blow thereto causing it to retract in an inward trajectory towards the shaft 12. Additionally, during its retraction the arm magnet 442 will magnetically engage the assembly magnet 444, disposing the spring target 410 in the inoperative position 404 for an indeterminate amount of time.

The spring target 410 will remain in the inoperative position 404 until the magnetic connection between the arm magnet 442 and the assembly magnet 444 is activated. As such, the activating system 430 includes a time switch mechanism 446 disposed within the housing 431 of the activating system 430 and structured to intermittently break the magnetic connection between the arm magnet 442 and the assembly magnet 444. More specifically, when the arm magnet 442 is in a magnetic engaging relation with the assembly magnet 444, the spring target 410 is in the inoperative position 404. When the time switch mechanism 446 randomly breaks the magnetic connection, the spring target 410 will return to the operative position 402. The random discharge cycle is indeterminate and may range from a split second to many seconds. As further indicated this adds to the overall dexterity of the user and provides a more challenging workout.

Further, when the magnetic connection is activated, the spring-arm assembly 400 is structured to deliver a directional force on the support arm segment 412 as described in greater detail hereinafter. Such a force will force the spring target 410 to extend in a transverse or outward direction back towards the user. As such, the spring-arm assembly 400 includes a biasing or spring structure 420 disposed about the support arm segment 412 between the target portion 414 and the bracket 401. Further, when the spring target 410 is disposed in the inoperative orientation 404, it is disposed in a retracted position relative to the support shaft 12. As such, the biasing structure 420 is calibrated or otherwise structured to be constricted between the target portion 414 of the spring target 410 and the bracket 401 as shown in FIG. 13.

However, when the magnetic connection between the arm magnet 442 and the assembly magnet 444 is activated, the biasing structure 420 is released back to its non-constricted form. This expansion of the biasing structure 420 creates a force which is exerted against the target portion 414 of the spring target 410. Such a biasing force will force the spring target 410 to extend in a transverse or outwardly direction relative to the support shaft 12. More specifically, the biasing structure 420 will exert a biasing force on the spring target 410 in an outward direction away from the shaft 12. This will serve to redirect the spring target 410 back towards the user. In turn, the user can appropriately react by purposefully delivering an additional blow to the returning spring target 410, dependent on the particular exercise or training activity which the user is practicing.

Figure 14:
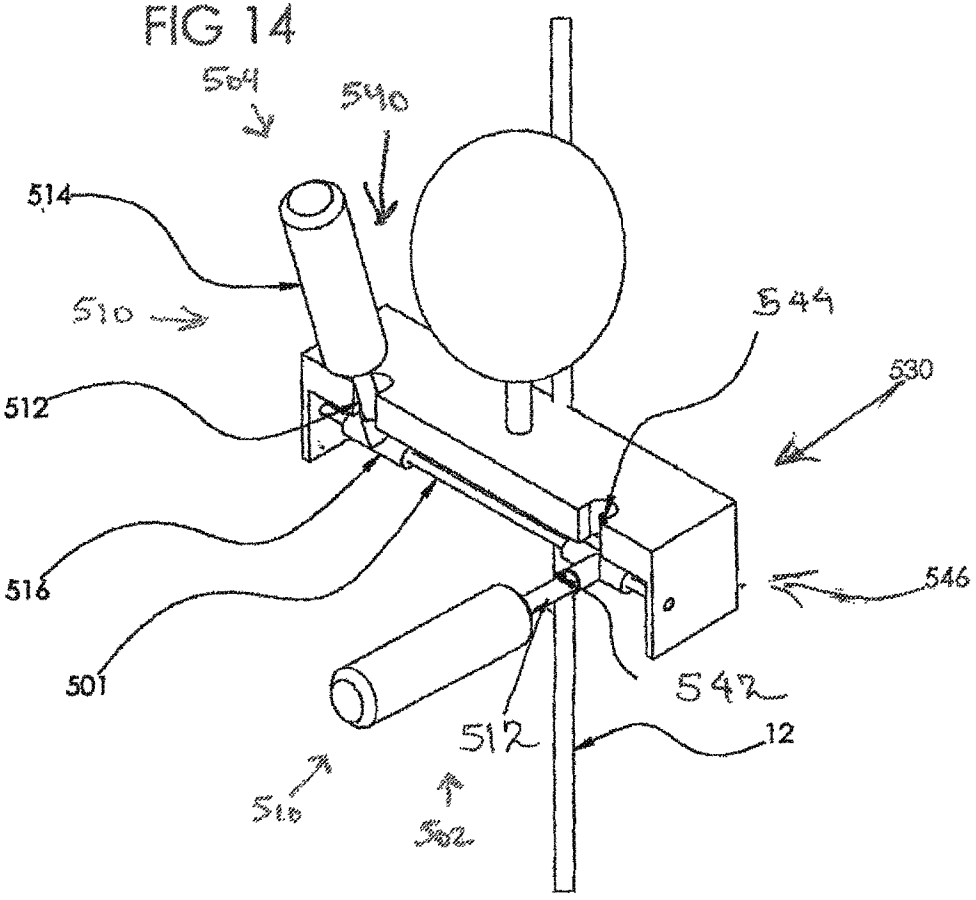
FIG. 14 is a perspective view of another preferred embodiment of an exercise assembly of the present invention.

As represented in FIG. 14, another preferred embodiment of the training assembly 10 includes a housing assembly 500 adjustably secured and transversely oriented to the vertically upright operative orientation of the shaft 12. The housing assembly 500 is adjustably but fixedly secured to the shaft 12 at a preferred location along the length thereof just above or below the head of the user. The height and/or position of the housing assembly 500 along the length of the shaft 12 may be dependent on the height or stature of the user or the particular activity being practiced by the user. The aforementioned housing assembly 500 is structured to support one or more drop targets 510. Each of the one or more drop targets 510 includes a support arm section 512 and a target section 514 structured to receive a blow from the user, when in an operative orientation 502. As discussed in detail hereinafter, each drop target 510 is operatively positioned between an outwardly extending orientation relative the shaft 12 and an aligned and/or substantially parallel orientation relative the shaft 12.

The housing assembly 500 includes a housing support bar 501 disposed in engaging, supporting relation to the corresponding end of each of the one or more drop targets 510. Such support may be considered necessary due to the plurality of drop targets 510 receiving repeated blows or punches from the user. As will be discussed in greater detail below, the housing support member 501 is structured to position and support each of the one or more drop targets 510 in an outwardly transverse orientation relative the shaft 12, when each of the one or more drop targets 510 is in an operative position 502. Such a housing support member 501 may be in the form of a pivot bar or the like.

The support arm section 512 extends substantially along the length of the drop target 510 and intermediate opposite ends of the drop target 510, or intermediate the attachment section 516 and the target section 514 located at the distal end of the drop target 510. As will be discussed in greater detail below, while the length of the support section 512 may vary, one feature thereof includes the addition of a magnetic connection 540 which will position each of the one or more drop targets 510 between an inoperative position 504 and an operative position 502.

Each of the one or more drop targets 510 also includes a target section 514 defining and extending along the length of the distal end of the drop target 510, inwardly towards the attachment section 516, which connects the drop target 510 to the housing support member 501. The length and overall structure of the target section 514 is such as to facilitate the receiving of any forceful blow delivered by the user. Accordingly, the support arm section 512 may be inwardly spaced from the target section 514 a sufficient distance to assure that any blow delivered to any of the drop targets 510 will engage the target section 514. Further, since the entire drop target 510 is formed of a light weighted material, such as but not limited to plastic, there will be no chance of damage to the user's hand, arm, etc. by the delivery of such a blow to the drop target 510.

The housing assembly 500 further includes an activating system 530 comprising a magnetic connection 540 between the support arm section 512 of the drop target 510 and the activating system 530. The activating system 530 is structured to position each of the drop targets 510 between an operative position 502 and an inoperative position 504. In one preferred embodiment of the training assembly 10 such a magnetic connection 540 may be, but is not limited to, an electromagnet. Further, the magnetic connection 540 includes an arm magnet 542 disposed on the support arm section 512 of the drop target 510 and an assembly magnet 544 disposed on the activating system 530. In one preferred embodiment of the training assembly 10 the assembly magnet 544 may be connected to the housing assembly 500 in a floating position, however in another embodiment it may be fixedly connected thereto.

As such, when the drop target 510 is in the operative position 502 the user may deliver an uppercut type blow to the drop target 510 causing it to pivot in an upward direction towards the shaft 12, away from the user. Further, during the upward pivot the arm magnet 542 will engage the assembly magnet 544 positioning the drop target 510 in the inoperative position 504 for an indeterminate amount of time. When the drop target 510 is in the inoperative position 504 it is disposed in an aligned and/or substantially parallel orientation relative the shaft 12. Additionally, the inoperative position 504 is maintained until the magnetic connection 540 is discharged, allowing the drop target 510 to gravitationally return to an outwardly transverse operative position 502. As such, each of the one or more activating systems 530 includes a time switch mechanism 546, structured to randomly discharge the magnetic connection 540 as discussed above. One intended operation of the one or many drop targets 510 is to facilitate a random release of the one or many drop targets 510 from an inoperative position 504 to an operative position 502 when the magnetic connection 540 is discharged. This will further facilitate the performance by a user of a relatively quick or rapid response movement when practicing either a boxing or martial arts technique, since the user will have to respond to the continuously released drop targets 510.

When disposed in the operative position 502, the drop target 510 is disposed in an outward extending relation to the shaft 12. As indicated above, the attachment section 516 of the drop target 510 extends horizontally outward therefrom in connected, supporting relation to the housing support member 501 of the housing assembly 500. Therefore, when the drop target 510 is in the operative position 502, it may include a substantially L-shape configuration relative the shaft 12.

As emphasized above, one operative feature of the exercise and/or training assembly 10 is the challenge to respond to the plurality of drop targets 510 as they each randomly release from an acute angular orientation to a transverse orientation relative the shaft 12. A striking uppercut type of blow by the user will force the drop target 510 to pivot in an upward direction, back towards the housing assembly 500. This will serve to return the drop target 510 back into the inoperative position 504. When the time switch mechanism 546 discharges the magnetic connection 540 the user can appropriately react to the returning drop target 510. As indicated, this adds to the overall dexterity of the user and provides a more challenging workout.

Figure 15:
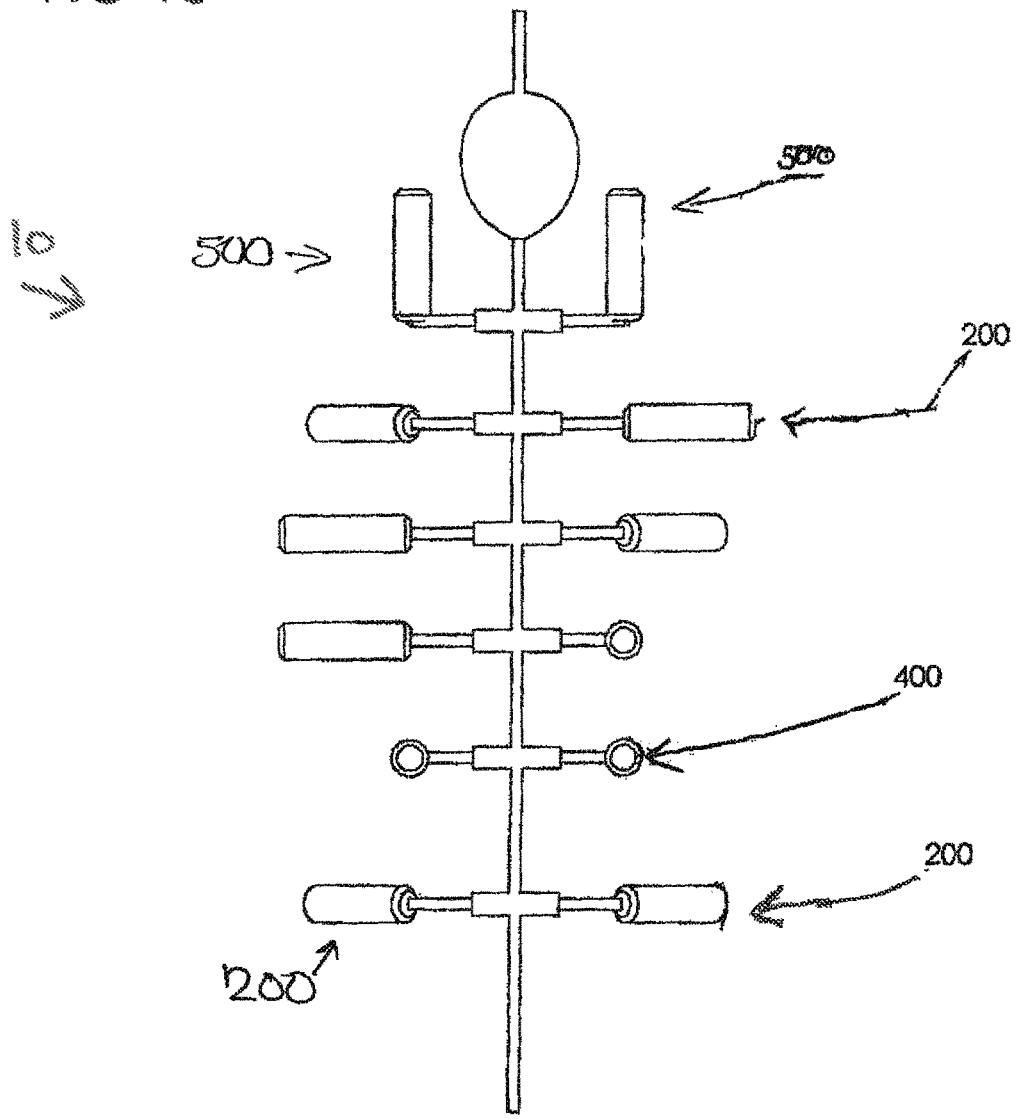
FIG. 15 is a perspective view of another preferred embodiment of an exercise assembly of the present invention.

The exercise and/or training assembly 10 may incorporate a plurality of different target structures and assemblies as described above, each of which is intended to receive repeated forceful blows as the user performs the intended boxing, martial arts, etc. routine. More specifically and with primary reference to FIG. 15, by way of example, the exercise and/or training assembly 10 may include a plurality of swing-arm assemblies 200, spring-target assemblies 400, and/or housing assemblies 500 adjustably connected to the shaft 12.

Figure 16:
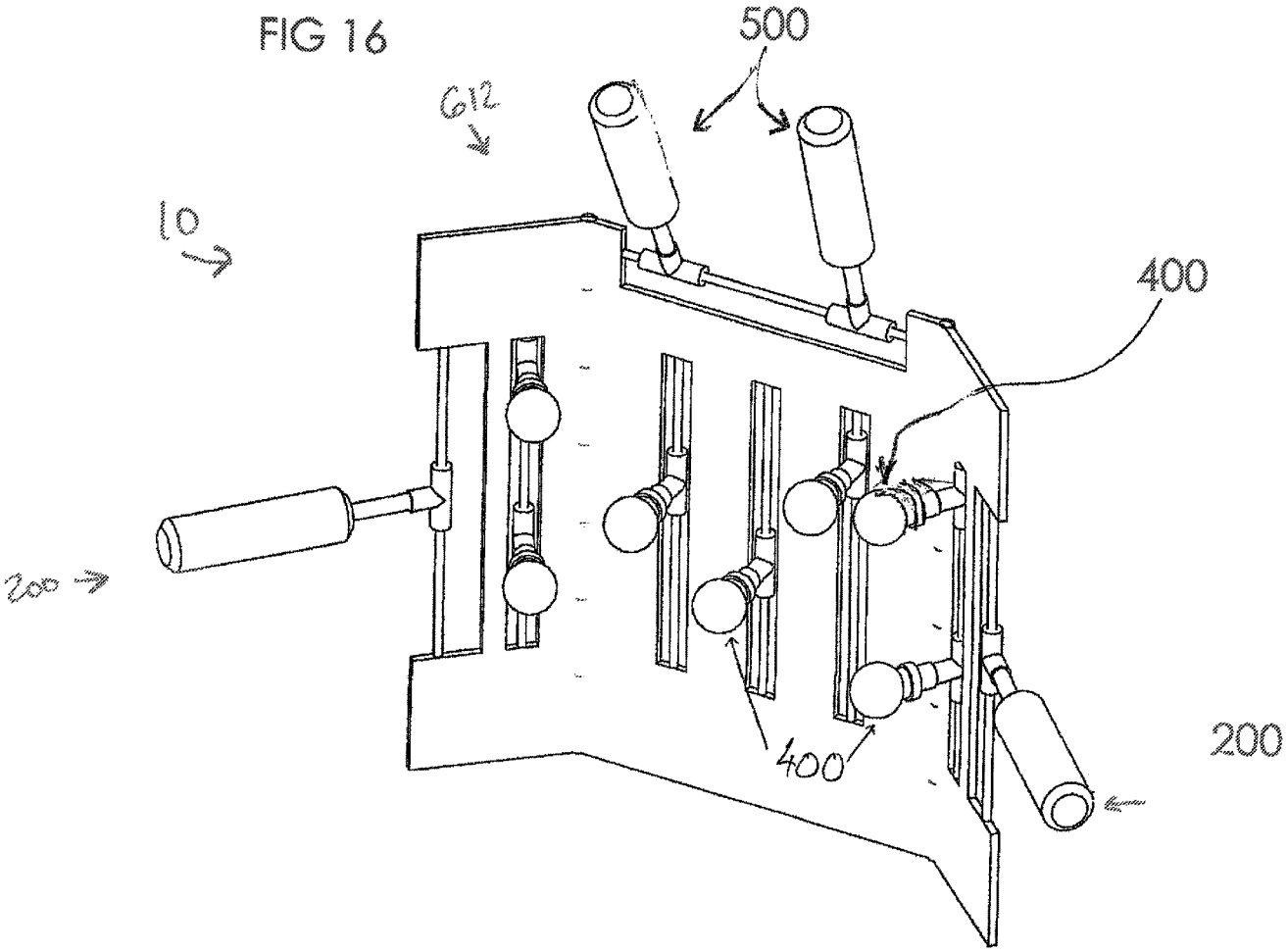
FIG. 16 is a perspective view of another preferred embodiment of an exercise assembly of the present invention.

However, in at least one embodiment, the training assembly 10 may include a plurality of the different target structures and assemblies as described above, mounted on a support 12 such as a vertically upright panel support structure 612. More specifically, the training assembly 10 includes an elongated panel support structure, generally indicated as 612. Further, with primary reference to FIG. 16, by way of example, the exercise and/or training assembly 10 may include a plurality of swing-arm assemblies 200, spring-target assemblies 400, and/or housing assemblies 500 adjustably connected to a 3-panel support structure 612.

Figure 17A:
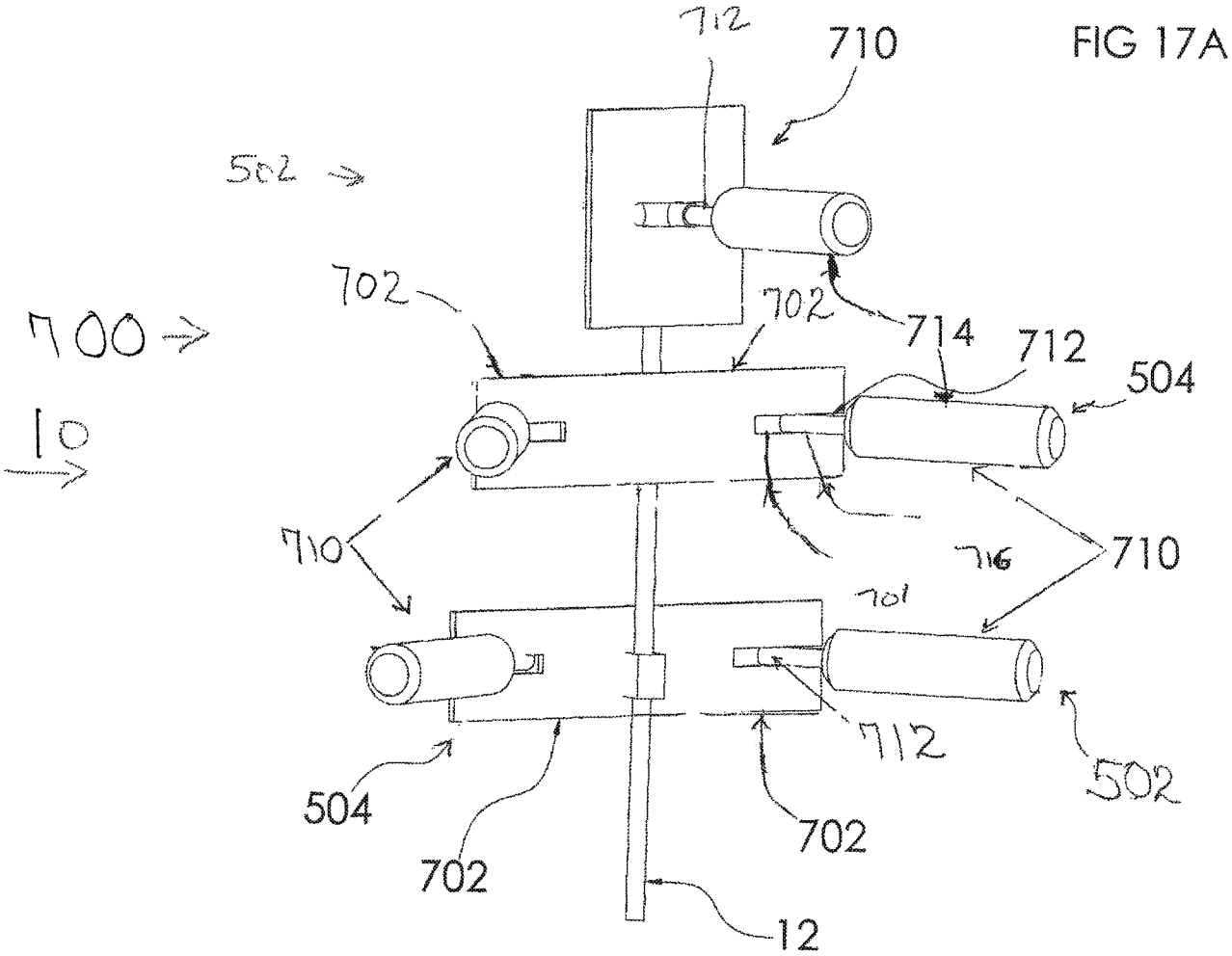
FIG. 17A is a perspective view of another preferred embodiment of an exercise assembly of the present invention.

As represented in FIGS. 17A and 17B, another preferred embodiment of the training assembly 10 may include a panel assembly illustrated at 700. The panel assembly 700 may include a base or support panel 702 adjustably secured to the shaft 12 at a user preferred location along the length thereof. The position of the support panel 702 along the length of the shaft 12 may be dependent on the height or stature of the user or the particular activity being practiced by the user. The support panel 702 may be structured to support at least one panel target 710. Each panel target 710 may comprise a support arm section 712 and a target section 714 structured to receive a blow from the user when in the operative orientation 502. As discussed in detail hereinafter, the panel target 710 may be operatively positioned between the operative position 502 and the inoperative position 504.

The support panel 702 may include a support member 701 disposed in supporting, connecting relation between the support panel 702 and the proximal end of the panel target 710. Such support may be considered necessary due to the panel target 710 receiving repeated blows or punches from the user. Further, the support member 701 may be structured to position and support the panel target 710 in an outwardly transverse orientation relative the shaft 12 when in the operative position 502, at such an angle that the user may deliver a blow or strike thereto.

The support arm section 712 may extend substantially along the length of the proximal end of the panel target 710, intermediate an attachment section 716 and the target section 714. The attachment section 716 may connect the panel target 710 to the support member 701. As will be discussed in greater detail below, while the length of the support arm section 712 may vary, one feature thereof may include the addition of a support pin 713 structured and disposed to engage an activating system 730, when the panel target 710 is positioned in the inoperative position 504.

As discussed above, the panel target 710 may include a target section 714 defining and extending along the length of a distal end of the panel target 710. The length and overall structure of the target section 714 may be such as to facilitate the receiving of repeated forceful blows delivered by the user. Accordingly, the support arm section 712 may be inwardly spaced from the target section 714 a sufficient distance to assure that any blow delivered to the panel target 710 will engage the target section 714 only. The panel target 710 may be formed of a light-weight material to reduce the chance of damage to the user's hand, arm, etc. by the delivery of such a blow to the panel target 710.

As illustrated in detain in FIG. 17B, the support panel 702 may also be structured to support an activating system 730, structured and disposed to position the panel target 710 between the operative position 502 and the inoperative position 504. The activating system 730 may comprise a catch 731 structured and disposed to engage the support pin 713 of the panel target 710, holding the panel target 710 in the inoperative position 504. This may happen via a blow from the user against the panel target 710 when in the operative position 502, such that the force of the blow may cause the panel target 710 to pivot in a direction away from the user and towards the support panel 702. On contact with the catch 731, the support pin 713 may engage and connect with the catch 731, positioning the panel target 710 in the inoperative position 504 for an indeterminate amount of time until released by the activating system 730.

Accordingly, the activating system 730 may include a switch mechanism 746, such as but not limited to a pull solenoid, structured to randomly activate and release the connected panel target 710 back into the operative position 502. The random activation of the switch mechanism 746 may be indeterminate or may be at least partially "preprogramed" so as to correspond "time wise" to the routine being performed by the user, and may range from a split second to many seconds. In one embodiment, this at least partial random activation may be caused by a programmable circuit board 733 and battery 734 connected to the switch mechanism 746 via electrical wires. More specifically, and as discussed in detail hereinafter, the switch mechanism 746 may include a plunger 738 structured to retract upon activation from the programmable circuit board 733 and to release upon deactivation.

As illustrated in detail in FIG. 17B, the activating system 730 may also include a sear 732 disposed in interconnecting relation between the catch 731 and the switch mechanism 746. The sear 732 may serve to hold or position the catch 731 in connecting relation to the support pin 713 of the panel target 710, when the catch 731 is engaged with the support pin 713. The switch mechanism 746 may be connected to the sear 732 via a connecting link 735, such that when the switch mechanism 746 is activated, it may exert a pulling force on the sear 732, causing the sear 732 to pivot while concurrently causing the connected catch 731 to move or rotate. Additionally, the catch 731 may include a catch biasing structure 736 structured to exert a biasing force upon the catch 731, causing additional movement or rotation of the catch 731. This combined movement or rotation of the catch may serve to release the support pin 713 from the catch 731, positioning the connected panel target 710 back into the operative position 502. Further, the sear 732 may include a sear biasing structure 737 structured to exert a biasing force upon the sear 732, on deactivation of the switch mechanism 746, causing the sear 732 and concurrently the catch 731, to pivot or rotate back into its original positions.

More specifically, the sear 732 may be disposed in interconnecting relation between the plunger 738 of the switch mechanism 746 and the sear biasing structure 737. Upon activation of the switch mechanism 746 by the programmable circuit board 733, the plunger 738 may retract, exerting a pulling force upon the sear 732 and sear biasing structure 737 via the connecting link 735. Such a pulling force may cause the sear biasing structure 737 to expand and the sear 732 to pivot while concurrently causing the catch 731 to rotate, releasing the support pin 713 and positioning the panel target 714 into the operative position 502. Upon deactivation of the switch mechanism 746, the plunger 738 may release, removing the pulling force applied to the sear 732 and sear biasing structure 737. This will cause the sear biasing structure 737 to exert a biasing force upon the sear 732, causing the sear 732 to pivot back into its original position, and concurrently causing the connected catch 731 to rotate back into its original position.

This will further facilitate the performance by a user of a relatively quick or rapid response movement when practicing either a boxing or martial arts technique, since the user will have to respond to the randomly released panel target 710.

Figure 18:
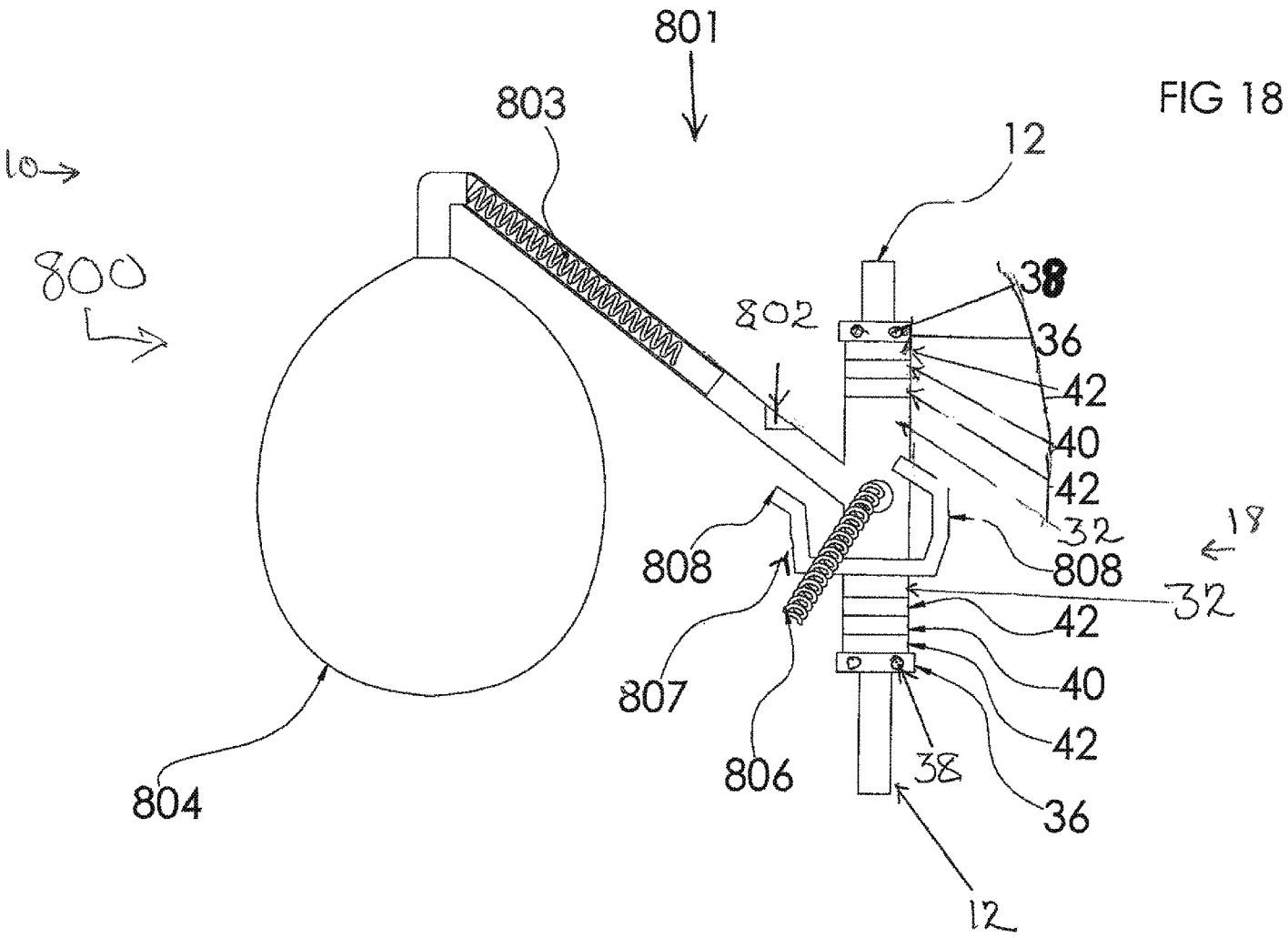
FIG. 18 is a perspective view of another preferred embodiment of an exercise assembly of the present invention.

As represented in FIG. 18, another embodiment of the exercise assembly 10 may include a head assembly generally indicated as 800. The head assembly 800 may include a target section 804 structured to be struck or receive a blow from the user. Such structuring of the target section 804 may also facilitate its use as a "speed bag" in a conventional manner in which such speed bags are used.

Further, the head assembly 800 may include an elongated arm 801 which may be rotationally or semi-rotationally connected to the support shaft 12 by a rotational fitting, generally indicated as 18. The elongated arm 801 may extend substantially outward from the shaft 12 in connected, supporting relation to the target section 804. The elongated arm 801 may comprise both a rigid portion 802 and a biasing or spring portion generally indicated as 803. The rigid portion 802 may extend along the length of a proximal end of the elongated arm 801 and intermediate opposite ends of the elongated arm 801 or intermediate the rotational fitting 18 and a distal end of the elongated arm 801. In order to provide a more optimal disposition of the target section 804 to receive repeated blows or punches from a user, the elongated arm 801 may be disposed at an acute angle relative to the length of the shaft 12. In at least one embodiment, a preferred angle of the elongated arm 801 may be, but is not limited to, being in the range of between 20° and 25°, relative the upright shaft 12. This predetermined angle may vary depending on the exercise practiced by the user.

The biasing portion 803 may define and extend along the length of the distal end of the elongated arm 801, disposed in interconnecting relation between the target section 804 and the rigid portion 802 of the elongated arm 801. Further, the biasing portion 803 may be calibrated and/or otherwise structured to absorb a portion of the force of a blow exerted on the target section 804, causing the biasing portion 803 and the target section 804 to move in an unpredictable manner. More specifically, after a blow is delivered to the target section 804, the spring element of the biasing portion 803 may expand and retract, creating additional "bobbing" movements to the target section 804. Also, the structural components of the rotational fitting 18, as set forth above, may be such as to cause a partial displacement or rotation of the elongated arm 801 about the shaft 12, after a blow from the user upon the target section 804. More specifically, the cooperative structuring of the elongated arm 801 and the rotational fitting 18 may be such that the elongated arm 801 at least partially rotates about the shaft 12 after a blow or punch is delivered to the target section 804 by the user.

Accordingly, as in FIG. 5, the rotational fitting 18 comprises an elongated primary segment 32 having a hollow interior and an outwardly extending connecting segment 34. The primary portion 32 may be disposed in concentrically surrounding relation to the shaft 12. The connecting segment 34 may extend transversely outward therefrom in connected, supporting relation to a remainder of the elongated arm 801. Further, the rotational fitting 18 may be adjustably secured along the length of the shaft 12 using at least two, oppositely disposed locking collars 36 movably or adjustably connected to the shaft 12 by a plurality of set screws or like connectors 38.

Associated with the rotational fitting 18, and operatively held in place by the locking collars 36, are two bearing assemblies generally indicated as 40. Each of the bearing assemblies 40 include two outwardly disposed washers 42 disposed in a sandwiching relation on opposite sides of a bearing structure 44, such as a thrust bearing or the like. The locking collars 36 may hold corresponding ones of the bearing assemblies 40 in an operative position relative to opposite open ends of the primary portion 32 of the rotational fitting 18. Therefore, at least a partial rotation of the connecting segment 34 and the elongated arm 801 connected thereto is facilitated.

However, in order to incorporate additional "unpredictable" movement of the target section 804, the present invention features the intended restricted rotation of the elongated arm 801 through a rotational path of less than 360° or less than a complete circular path about the longitudinal axis of the shaft 12. As such, the head assembly 800 may include a restriction biasing structure 806, which may be considered a part of the rotational fitting 18 rotationally connected to the shaft 12, structured and disposed to restrict the rotation of the elongated arm 801. However, as represented in FIG. 18, the restriction biasing structure 806 extends transversely outward from the shaft 12 at such a disposition that it will not engage the elongated arm 801, but will rotate therewith.

To effectuate the rotation restriction of the elongated arm 801, the restriction biasing structure 806 may work in combination with a restriction guide 807, which may be fixedly but adjustably secured to the shaft 12. The restriction guide 807 may include two, spaced-apart restriction arms 808, structured to engage and restrict the rotation of the restriction biasing structure 806 to the space between the two restriction arms 808. More specifically, the restriction biasing structure 806 may be disposed between the two restriction arms 808 and structured to engage one of the restriction arms 808 during its rotation about the shaft 12. As such, the restriction guide 807 and the two restriction arms 808 may collectively define a substantially V-shape, as represented in FIGS. 18A-18B, configuration about the restriction biasing structure 806.

Accordingly, the force exerted by a blow or punch delivered to the target section 804 by a user may cause at least a partial rotation of the elongated arm 801. Due to the fact that the elongated arm 801 and the restriction biasing structure 806 are both connected to the rotational fitting 18, a blow exerted on the target section 804 will result in a concurrent rotation of the restriction biasing structure 806. When so rotated, the restriction biasing structure 806 will engage one of two the restriction arms 808, depending on the direction of rotation of the restriction biasing structure 806. Upon such engagement, the rotation of both the restriction biasing structure 806 and the elongated arm 801 will be halted. As such, the elongated arm 801 may only rotate about the shaft 12 a distance equal to the space between the two restriction arms 808.

In addition, after engagement with one of the two restriction arms 808, the restriction biasing structure 806 may be disposed and calibrated or otherwise structured to deliver or impose a directional, biasing force thereon. Such a biasing force may cause the restriction biasing structure 806 and the elongated arm 801 to rotate in an opposite direction, back towards the user. More specifically, the restriction biasing structure 806 may exert a biasing force in a direction which is substantially opposite to the initial direction of the elongated arm 801 along its intended path of travel. This will serve to reverse and redirect the rotation of the elongated arm 801 back towards the user. In turn, the user can appropriately react by purposefully delivering an additional blow to the connected target section 804.

Figure 18B:
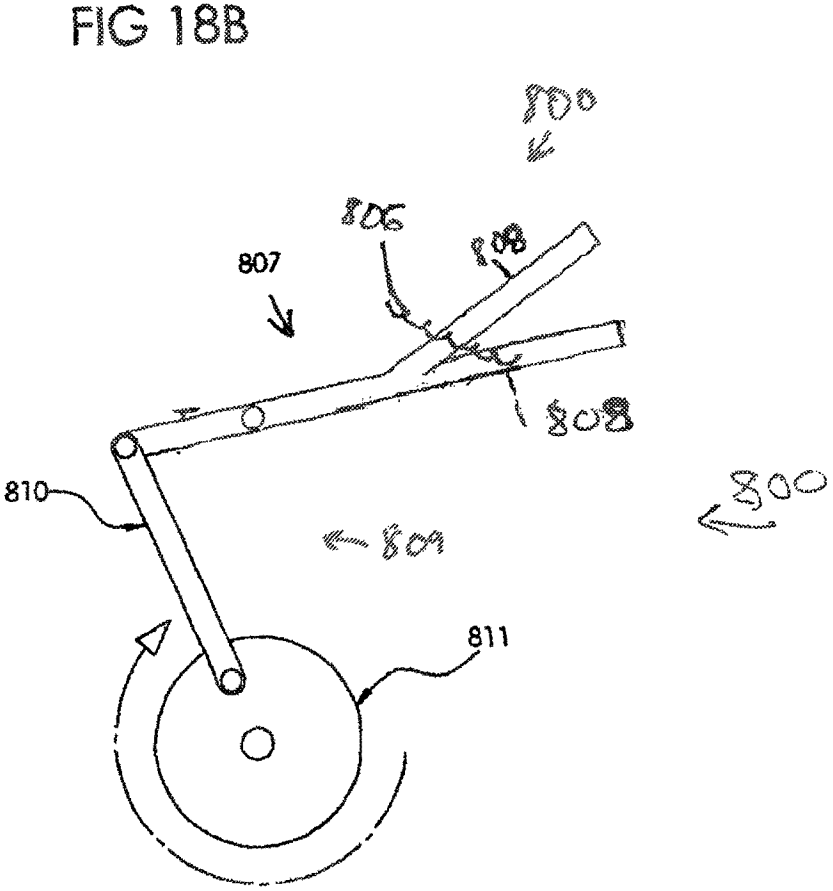
FIG. 18B is a detail view of a component of the embodiment of FIG. 18.
Figure 18A:
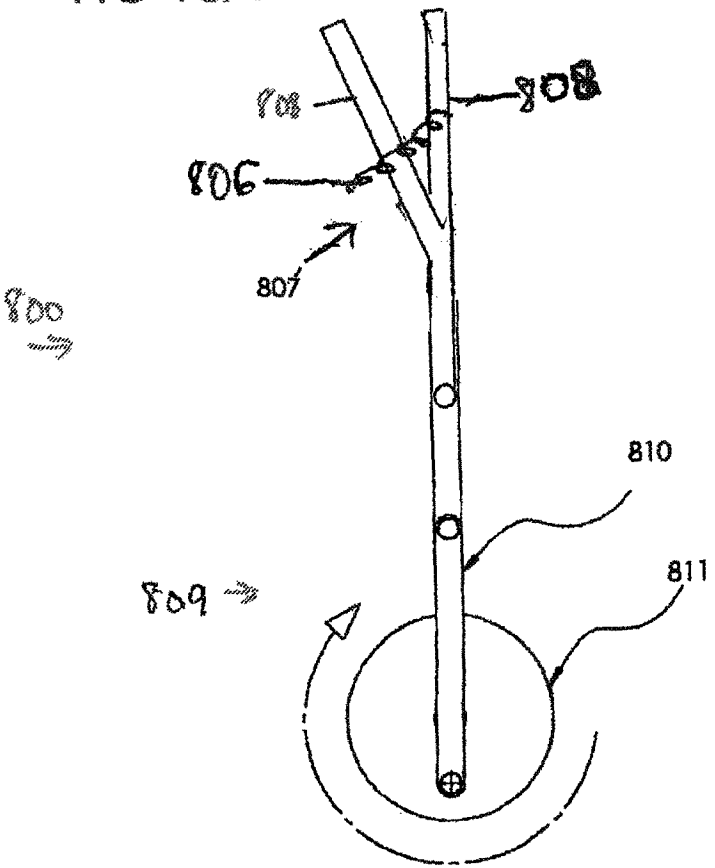
FIG. 18A is a detail view of a component of the embodiment of FIG. 18.
Figure 18C:
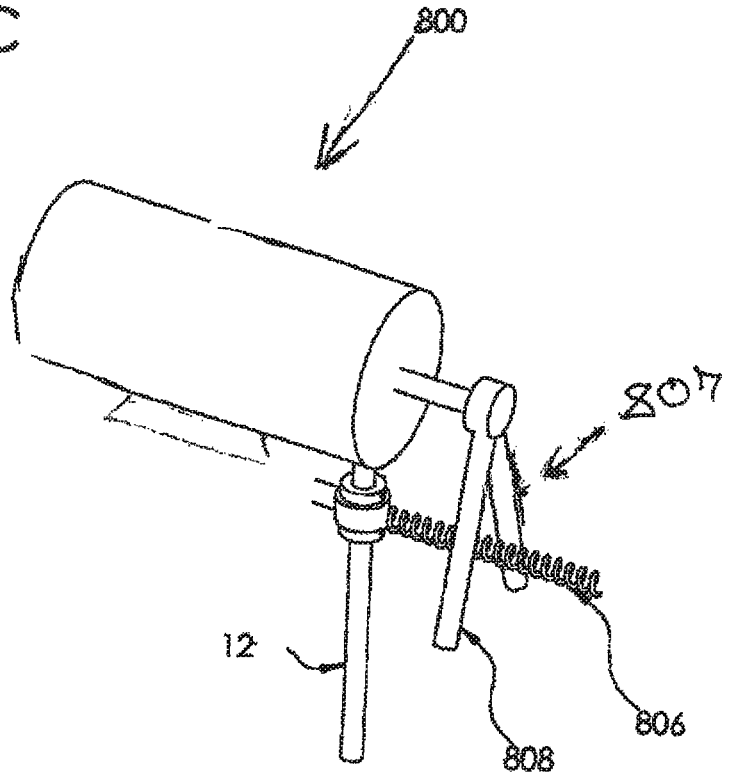
FIG. 18C is a detail view of a component of the embodiment of FIG. 18.
Figure 18D:
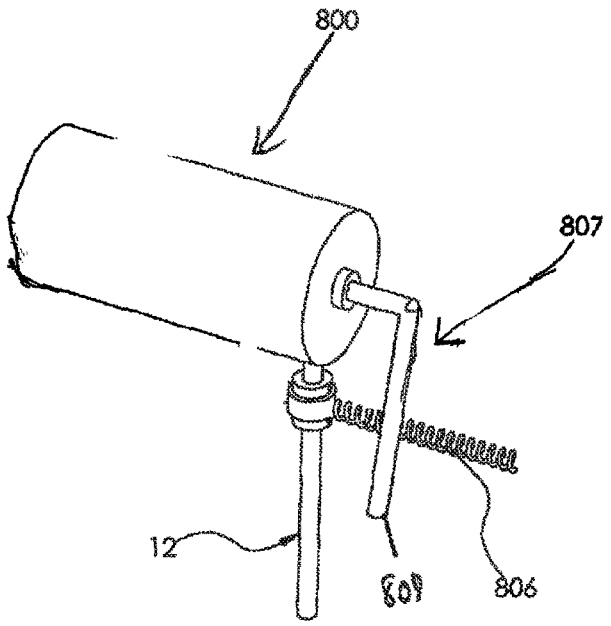
FIG. 18D is a detail view of a component of the embodiment of FIG. 18.

As illustrated in FIG. 18C, in one embodiment, the restriction guide 807, may be mounted on the shaft 12 in a substantially reversed orientation from that represented in FIGS. 18A-18B, above the restriction biasing structure 806. As such, the restriction guide 807 and the two restriction arms 808 may collectively define a substantially A-shape configuration about the restriction biasing structure 806. Further, the restriction guide 807 may be connected to a motor structured to cause the restriction arms 808 to move in a "side to side" motion, engaging the restriction biasing structure 806. This will serve to cause frequent contact between the restriction arms 808 and the restriction biasing structure 806 disposed there between, which may add to the unpredictable movement of the target section 804 as described above. As illustrated in FIG. 18D, in another embodiment, the inverted restriction guide 807 may only include one restriction arm 808' structured and disposed to rotate around and engage with the restriction biasing structure 806.

In one embodiment, as illustrated in FIGS. 18A-18B, to provide additional "unpredictable" movement to the target section 804, the restriction guide 807 may be pivotally secured to the shaft 12. More specifically, at least one of the two restriction arms 808 may independently move or pivot such that the rotating restriction biasing structure 806 may engage one of the two restriction arms 808 at different locations and/or angles depending on the movement or pivot thereof. This may serve to alter the initial rotational distance of the restriction biasing structure 806 as it travels away from the user and/or alter the speed of the returning restriction biasing structure 806 back towards the user after engagement with one of the restriction arms 808.

To effectuate the movement or pivot of at least one of the restriction arms 808, the restriction guide 807 may include a pivot mechanism 809, such as but not limited to a slider crank mechanism, structured to move or pivot the restriction guide 807. The pivot mechanism 809 may include a connecting rod 810, pivotally connected between the restriction guide 807 and a pivot wheel 811. Accordingly, when the restriction biasing structure 806 engages the restriction guide 807, the energy created by the linear rotation of the restriction biasing structure 806 may be transferred to the pivot mechanism 809 as mechanical rotational energy. More specifically, the linear rotation of the restriction biasing structure 806 may be transformed into a rotary motion at the pivot wheel 811 via the connecting rod 810. As such, the pivot wheel 811 may rotate. The rotary motion of the pivot wheel 811 may then be transformed into a linear motion at the restriction guide 807 via the connecting rod 810, causing at least one of the restriction arms 808 to move or pivot. In one embodiment, the rotary motion of the pivot wheel 810 may be perpetuated via a motor.

Figure 19:
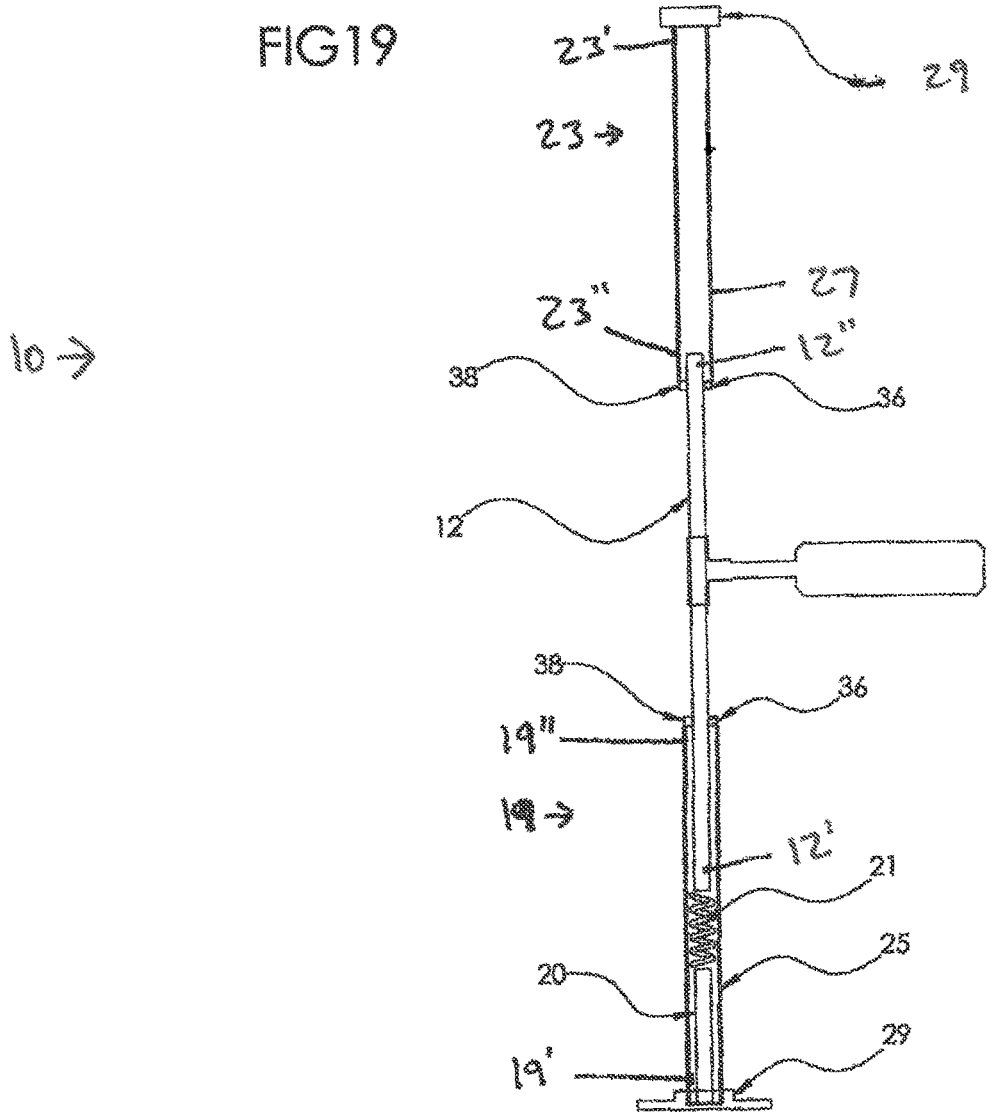
FIG. 19 is a perspective view of another preferred embodiment of an exercise assembly of the present invention.

As illustrated in FIG. 19, in another preferred embodiment, the training assembly 10 may include additional structural and operative versatility to facilitate the support and mounting of the support shaft 12. More specifically, the elongated support shaft 12 may be vertically mounted on a floor or other supporting surface and on a ceiling or other supporting structure located a sufficient distance above the floor supporting structure. This will serve to anchor the shaft 12 at both ends adding additional support thereto. Such reliable mounting of the support shaft 12 from the "floor to the ceiling", as well as a plurality of target structures mounted thereon, is important due to the fact that the training assembly 10 is intended to be repeatedly struck by the user. The overall length of the shaft 12 may be preferably in the range of between 8 and 10 feet. Such a length allows the training assembly 10 to vertically mount to most "floor to ceiling" structures. This preferred length further provides a user of the exercise assembly 10 with a greater amount of areas to train or exercise.

In cooperation with the shaft 12, a bottom and top sleeve structure 19, 23, may be removably mounted on each end thereof while concurrently engaging the floor and ceiling structures respectively. More specifically, the bottom sleeve structure 19 may be removably connected to a floor structure and a lower portion 12' of the shaft 12, and the top sleeve structure 23 may be removably connected to a ceiling structure and an upper portion 12" of the shaft 12. Such reliable mounting of the support shaft 12 is important due to the fact that the support assembly 10 is intended to be repeatedly "struck" as a user performs various boxing, martial arts and/or like activities, while utilizing the exercise assembly 10. Such support of the training assembly 10 against floor and ceiling structures may be further facilitated by the inclusion of slip-resistant and/or traction enhancing structures 29 mounted on proximal ends 19', 23', of the bottom and top sleeve structures 19, 23. The slip-resistant structures 29 may be disposed so as to anchor the training assembly 10 to the floor and ceiling structures, such that the user may practice the intended exercise and or training activity.

The top sleeve structure 23 may comprise a top exterior segment 27 having a hollow interior. When disposed in its operative position, the top exterior segment 27 may be disposed in concentrically surrounding relation to the upper portion 12" of the shaft 12. The bottom sleeve structure 19 may comprise a bottom exterior segment 25 having a hollow interior. When disposed in its operative position, the bottom exterior segment 25 may be disposed in concentrically surrounding relation to the lower portion 12' of the shaft 12. Further, the bottom sleeve structure 19 may include an interior restriction segment 20 and an interior biasing member 21 removably mounted or connected inside of the bottom exterior segment 25. More specifically, the interior restriction segment 20 may be removably inserted in, and extend substantially along, the interior length of the proximal end 19' of the bottom sleeve structure 19. The interior biasing member 21 may be disposed in movably, resiliently interconnecting relation between the interior restriction segment 20 and the lower end 12' of the shaft 12.

Further, when the interior biasing member 21 is in interconnecting relation with the shaft 12, it may be disposed in a retracted, compressed position due to the force and/or weight of the shaft 12. As such, the interior biasing member 21 is calibrated or otherwise structured to be constricted between the shaft 12 and the interior restriction segment 20. Further, the top and bottom sleeve structures 19, 23, may be adjustably secured along the length of the shaft 12 via locking collars 36 movably or adjustably connected to the shaft 12 by a plurality of set screws or like connectors 38. More specifically, the bottom locking collar 36 may hold the shaft 12 against the interior biasing member 21 while in the retracted, compressed position when interconnected between the shaft 12 and the interior restriction segment 20. This will serve to allow the user to mount the top sleeve structure 23 against the ceiling and lock the upper end 12" of the shaft 12 therein via the top locking collar 36.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An exercise assembly structured to be struck by a user, said exercise assembly comprising:

a support disposed in supporting relation to at least one target, said at least one target disposed between an operative position and an inoperative position and structured to be struck by the user, at least when said one target is in said operative position, at least one activating system structured to dispose said one target between said operative and inoperative positions, said at least one activating system comprising a connection between said one target and said activating system and a switch mechanism structured to intermittently break said magnetic connection, and said connection including a magnetic connection; said switch mechanism including an electric switch mechanism structured to activate said magnetic connection.

2. The exercise assembly as recited in claim 1 wherein said at least one activating system disposed to orient said at least one target into said operative position, when said connection is broken by said switch mechanism.

3. The exercise assembly as recited in claim 1 wherein said activating system comprises a biasing structure disposed and structured to exert a driving force on said one target in an accessible position relative to the user, when said connection is broken by said switch mechanism.

4. The exercise assembly as recited in claim 1 wherein said connection comprises an arm connection disposed on said one target and an assembly connection disposed on said activating system.

5. The exercise assembly as recited in claim 4 wherein said arm connection is in engaging relation with said assembly connection when said target is in said inoperative position.

6. The exercise assembly as recited in claim 1 wherein said at least one target is adjustably connected to said support in predetermined relation to the user; said target including a target portion disposed and structured to be struck by the user; a support member disposed in interconnecting relation between said target portion and said support.

7. An exercise assembly structured to be struck by a user, comprising:

a support disposed in supporting relation to at least one target, disposed on and extending vertically from a supporting surface, said at least one target positionable between an operative position and an inoperative position and disposed and structured to be struck by the user, at least when said one target is in said operative position, at least one activating system structured to position said one target between said operative and inoperative positions, said at least one activating system comprises a magnetic connection between said one target and said activating system and an electric switch mechanism structured to intermittently activate said magnetic connection, and said at least one activating system disposed to orient said at least one target into said operative position, when said magnetic connection is activated by said electric switch mechanism.

8. The exercise assembly as recited in claim 7 wherein said at least one target comprises at least one rotating target rotationally connected to said support and extending outward therefrom.

9. The exercise assembly as recited in claim 8 wherein said activating system comprises a biasing structure disposed in an interruptive position relative to a rotational path of travel of said one rotating target.

10. The exercise assembly as recited in claim 9 wherein said interruptive position comprises said biasing structure disposed to restrict rotation of said rotating target along said rotational path of travel, about said support to less than 360°.

11. The exercise assembly as recited in claim 9 wherein said biasing structure is disposed and structured to exert a driving force on said one rotating target in a direction opposite to that of said rotational path of travel, when said magnetic connection is activated by said electronic switch mechanism.

12. The exercise assembly as recited in claim 8 wherein said magnetic connection comprises an arm magnet disposed on said at least one rotating target and an assembly magnet disposed on said at least one activating system.

13. The exercise assembly as recited in claim 12 wherein said arm magnet is in magnetic engaging relation with said assembly magnet when said at least one target is in said inoperative position.

14. The exercise assembly as recited in claim 7 wherein said at least one target comprises at least one spring target connected to said support.

15. The exercise assembly as recited in claim 14 wherein said magnetic connection comprises an arm magnet disposed on said at least one spring target and an assembly magnet disposed on said at least one activating system.

16. The exercise assembly as recited in claim 15 wherein said arm magnet is in magnetic engaging relation with said assembly magnet when said at least one target is in said inoperative position.

17. The exercise assembly as recited in claim 14 wherein said activating system comprises a biasing structure disposed to orient said at least one spring target into said operative position in an outwardly transverse relation to said support.

18. The exercise assembly as recited in claim 17 wherein said biasing structure is structured to exert a driving force on said one spring target in an accessible position relative to the user, when said magnetic connection is activated by said electric switch mechanism.

* * * * *